US012559878B2

(12) United States Patent
Bixby et al.

(10) Patent No.: US 12,559,878 B2
(45) **Date of Patent: *Feb. 24, 2026**

(54) PET HAIR FILTER

(71) Applicant: WHIRLPOOL CORPORATION, Benton Harbor, MI (US)

(72) Inventors: Seth E. Bixby, Stevensville, MI (US); Sayer J. Murphy, Saint Joseph, MI (US); Thomas D. Spicer, Saint Joseph, MI (US); Eric J. Vasko, Saint Joseph, MI (US); Heather A. Hellmuth, St. Joseph, MI (US); Michael A. Ledford, St. Joseph, MI (US); Meagan K. Vandervelde, St. Joseph, MI (US)

(73) Assignee: WHIRLPOOL CORPORATION, Benton Harbor, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/631,391

(22) Filed: Apr. 10, 2024

(65) Prior Publication Data

US 2024/0254680 A1 Aug. 1, 2024

Related U.S. Application Data

(63) Continuation of application No. 17/584,010, filed on Jan. 25, 2022, now Pat. No. 11,982,039.

(Continued)

(51) Int. Cl.

| | |
|---|---|
| ***D06F 39/10*** | (2006.01) |
| ***D06F 13/02*** | (2006.01) |
| ***D06F 17/10*** | (2006.01) |

(52) U.S. Cl.

CPC ..... *D06F 39/10* (2013.01); *D06F 13/02* (2013.01); *D06F 17/10* (2013.01)

(58) Field of Classification Search

CPC ..... D06F 13/02; D06F 17/10; D06F 39/10

See application file for complete search history.

(56) References Cited

U.S. PATENT DOCUMENTS

| | | | |
|---|---|---|---|
| 2,399,319 | A | 4/1946 | Bowen et al. |
| 2,481,979 | A | 9/1949 | Colley |

(Continued)

FOREIGN PATENT DOCUMENTS

| | | | |
|---|---|---|---|
| CN | 2649624 | Y | 10/2004 |
| CN | 104736217 | A | 6/2015 |

(Continued)

*Primary Examiner* — Joseph L. Perrin

(74) *Attorney, Agent, or Firm* — BROOKS KUSHMAN P.C.

(57) ABSTRACT

A removable fluid pumping and filtration apparatus for a laundry treatment machine is provided. The apparatus includes a plurality of selectively attachable and detachable stackable sections, the sections including a handle section and one or more further sections; wherein, when attached together in stacked arrangement to form an agitator, the plurality of sections collectively define: a cylindrical body, a hollow interior of the body, first and second opening about the exterior circumference of the body to define a water flow path into and out of the hollow interior, and placement within the hollow interior for a removable filter along the water flow path, and wherein the handle section including an area to grip onto and rotate the removable fluid pumping and filtration apparatus to facilitate insertion and removal of the agitator.

20 Claims, 24 Drawing Sheets

Related U.S. Application Data

(60) Provisional application No. 63/142,815, filed on Jan. 28, 2021.

(56) References Cited

U.S. PATENT DOCUMENTS

| | | | |
|---|---|---|---|
| 2,942,444 | A | 6/1960 | Abresch |
| 2,976,711 | A | 3/1961 | Smith |
| 3,111,831 | A | 11/1963 | Tope et al. |
| 4,003,225 | A | 1/1977 | Worst |
| 4,338,802 | A | 7/1982 | Ohmann et al. |
| 4,402,198 | A | 9/1983 | Cartier |
| 4,417,457 | A | 11/1983 | Brenner |
| 4,419,870 | A | 12/1983 | Brenner |
| 5,611,221 | A | 3/1997 | Tremel |
| 5,878,600 | A | 3/1999 | Yeo et al. |
| 9,022,223 | B1 | 5/2015 | Wright |
| 2004/0016267 | A1 | 1/2004 | Clark et al. |
| 2018/0313021 | A1 | 11/2018 | Piekarski et al. |
| 2018/0313022 | A1 | 11/2018 | Piekarski et al. |
| 2018/0313023 | A1 | 11/2018 | Piekarski et al. |
| 2018/0313024 | A1 | 11/2018 | Piekarski et al. |
| 2019/0017208 | A1 | 1/2019 | Marangoni et al. |
| 2019/0062978 | A1 | 2/2019 | Czarnecki et al. |

FOREIGN PATENT DOCUMENTS

| | | | |
|---|---|---|---|
| CN | 114197146 | A | 3/2022 |
| GB | 1082896 | | 9/1967 |
| JP | S60185590 | A | 9/1985 |
| WO | 2014022193 | A1 | 2/2014 |

PET HAIR FILTER

CROSS-REFERENCE TO RELATED APPLICATIONS

This application is a continuation application of U.S. application Ser. No. 17/584,010, filed Jan. 25, 2022, now as U.S. Pat. No. 11,982,039 on May 14, 2024, which claims the benefit of U.S. provisional application Ser. No. 63/142,815 filed Jan. 28, 2021, the disclosures of which are hereby incorporated in their entirety by reference herein.

TECHNICAL FIELD

Aspects of the disclosure generally relates to removable agitators for laundry treating appliances, and in particular to removable agitators having built-in filtration capabilities.

BACKGROUND

Laundry treating appliances, such as clothes washers, clothes dryers, washing machines, refreshers, and non-aqueous systems, can have a configuration based on a container, such as a laundry basket or drum that defines a drum opening, which may or may not rotate, and that at least partially defines a treating chamber in which laundry items are placed for treating. The laundry treating appliance can have a controller that implements a number of user-selectable, pre-programmed cycles of operation having one or more operating parameters. Hot water, cold water, or a mixture thereof, along with various treating chemistries, or detergents, can be supplied to the treating chamber in accordance with the cycle of operation.

Laundry treating appliances typically operate to treat laundry items by placing the laundry items in contact with treating fluid such as a detergent/water mixture, sometimes referred to as wash liquor, and providing relative motion between the laundry items and the fluid. The controller can further control a motor to rotate the laundry basket or drum according to one of the pre-programmed cycles of operation. The controller can also control a clothes mover provided within the laundry basket or drum and configured to impart mechanical energy to laundry items within the treating chamber according to a selected cycle of operation. The clothes mover can include multiple components, such as a base, which can be provided as an impeller plate, and a barrel, which can be provided as an agitator post, and which can couple to the base.

Filters are used in laundry treating appliances to capture pet hair, lint, and other particulate from laundry loads. The captured particulate is retained inside the filter, allowing the consumer to clean the filter after a wash cycle is completed. For customers who do not use clothes drying appliances, it is especially important to trap lint during the wash cycle.

SUMMARY

In one or more illustrative examples, a removable fluid pumping and filtration apparatus for a laundry treatment machine is provided. The apparatus includes a handle section defining a grip to facilitate insertion and removal of the apparatus into the laundry treatment machine; an impeller section defining a hollow interior having a closed bottom, generally cylindrical sides, and an open top, the impeller section further defining a lower water opening to allow for passage of wash water into or out of the hollow interior of the apparatus; and a filter section, of a generally cylindrical shape and removably attachable between the handle section and the impeller section, the exterior of the filter section defining a midsection water opening to allow for the passage of water into or out of the interior of the apparatus, the filter section having a partition further defining a first, inner space open to the hollow interior of the impeller section, a second, outer space open to the midsection water opening but closed to the first space, and a filter area open to the first and second spaces configured to hold a removable filter to filter water flowing between the inner space and the outer space.

In one or more illustrative examples, a removable fluid pumping and filtration apparatus for a laundry treatment machine is provided. The apparatus includes a handle section defining a grip to facilitate insertion and removal of the apparatus into the laundry treatment machine, and an upper water opening into a passage in the interior of the apparatus; and a filter section of a generally cylindrical shape, removably attachable to the bottom of the handle section, the filter section defining a hollow interior having a closed bottom, generally cylindrical sides, an open top, and a lower water opening to allow for the passage of water into or out of the hollow interior of the apparatus, the filter section configured to hold filter media, wherein, when the handle section is attached to the filter section, the handle section and the filter section collectively define a water flow path for wash water in or out of the upper water opening into the interior of the filter media, through the filter media, and in or out of the lower water opening.

In one or more illustrative examples, a removable fluid pumping and filtration apparatus for a laundry treatment machine is provided. The apparatus includes a plurality of selectively attachable and detachable stackable sections, the sections including a handle section and one or more further sections, wherein, when attached together in stacked arrangement to form an agitator, the plurality of sections collectively define a cylindrical body, a hollow interior of the body, and first and second openings about an exterior circumference of the body to define a water flow path into and out of the hollow interior, wherein the agitator defines a filter holder within the hollow interior configured to hold a removable filter along the water flow path to capture particulate in wash water, and the handle section including an area to grip onto and rotate the removable fluid pumping and filtration apparatus to facilitate insertion and removal of the agitator with respect to the laundry treatment machine.

DETAILED DESCRIPTION

As required, detailed embodiments of the present invention are disclosed herein; however, it is to be understood that the disclosed embodiments are merely exemplary of the invention that may be embodied in various and alternative forms. The figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

Figure 1:
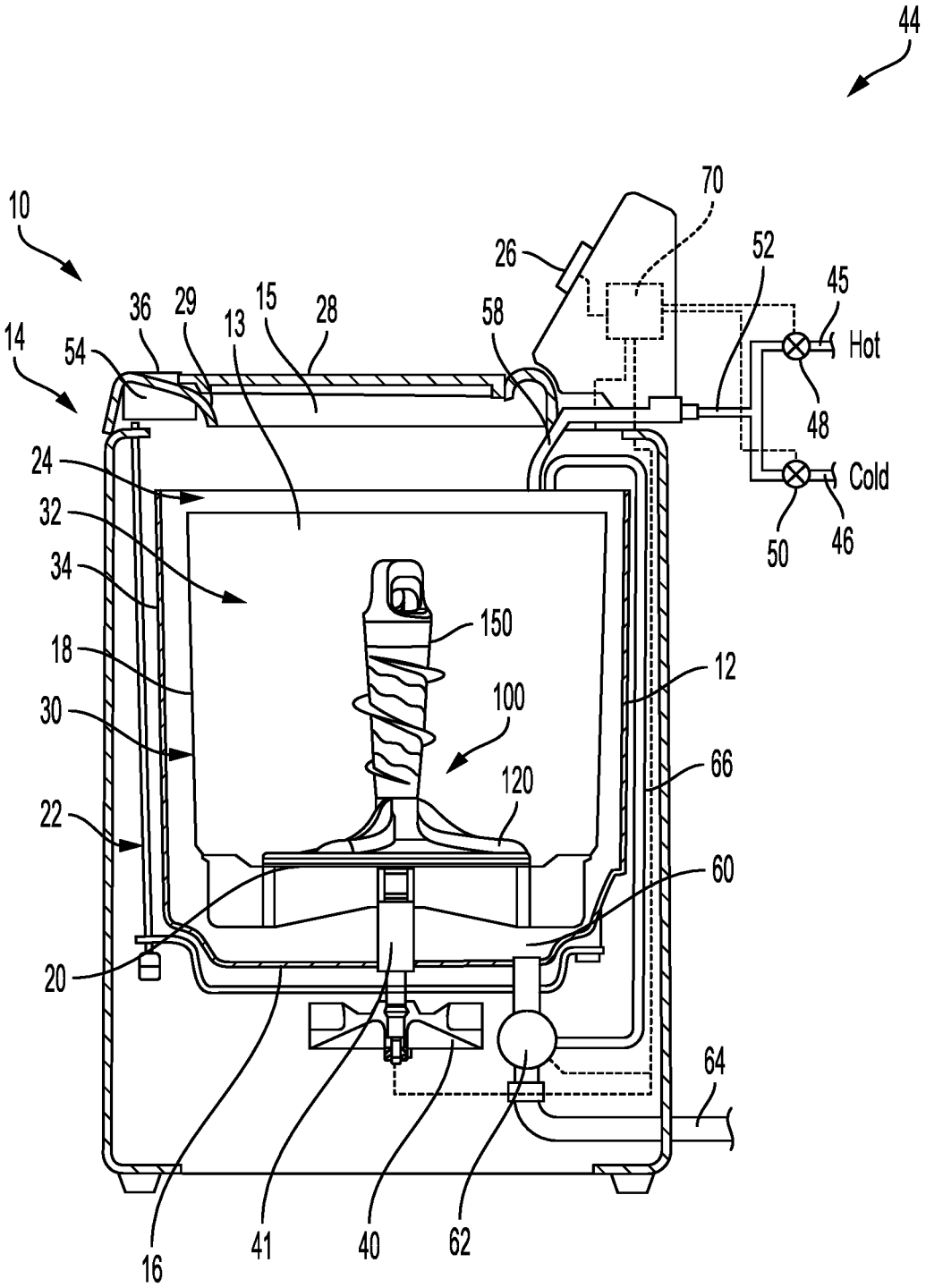
FIG. 1 is a simplified cross-sectional view of a laundry treating appliance including a removable filtering agitator.

FIG. 1 is a simplified view of a laundry treating appliance 10 including a removable filtering agitator 150. The laundry treating appliance 10 can be any laundry treating appliance 10 that performs a cycle of operation to clean or otherwise treat laundry items placed therein, non-limiting examples of which include a horizontal or vertical axis clothes washer; a clothes dryer; a combination washing machine and dryer; a dispensing dryer; a tumbling or stationary refreshing/revitalizing machine; an extractor; a non-aqueous washing apparatus; and a revitalizing machine. While the laundry treating appliance 10 is illustrated herein as a vertical axis, top-load laundry treating appliance 10, the aspects of the present disclosure can have applicability in laundry treating appliances with other configurations. The laundry treating appliance 10 shares many features of a conventional automated clothes washer and/or dryer, which will not be described in detail herein except as necessary for a complete understanding of the exemplary aspects in accordance with the present disclosure.

Laundry treating appliances are typically categorized as either a vertical axis laundry treating appliance or a horizontal axis laundry treating appliance. As used herein, the term "horizontal axis" laundry treating appliance refers to a laundry treating appliance having a rotatable drum that rotates about a generally horizontal axis relative to a surface that supports the laundry treating appliance. The drum can rotate about the axis inclined relative to the horizontal axis, with fifteen degrees of inclination being one example of the inclination. Similar to the horizontal axis laundry treating appliance, the term "vertical axis" laundry treating appliance refers to a laundry treating appliance having a rotatable drum that rotates about a generally vertical axis relative to a surface that supports the laundry treating appliance. However, the rotational axis need not be perfectly vertical to the surface. The drum can rotate about an axis inclined relative to the vertical axis, with fifteen degrees of inclination being one example of the inclination.

In another aspect, the terms vertical axis and horizontal axis are often used as shorthand terms for the manner in which the appliance imparts mechanical energy to the laundry, even when the relevant rotational axis is not absolutely vertical or horizontal. As used herein, the "vertical axis" laundry treating appliance refers to a laundry treating appliance having a rotatable drum, perforate or imperforate, that holds fabric items and, optionally, a clothes mover, such as an agitator, impeller, nutator, and the like within the drum. The clothes mover can move within the drum to impart mechanical energy directly to the clothes or indirectly through wash liquid in the drum. The clothes mover can typically be moved in a reciprocating rotational movement. In some vertical axis laundry treating appliances, the drum rotates about a vertical axis generally perpendicular to a surface that supports the laundry treating appliance. However, the rotational axis need not be vertical. The drum can rotate about an axis inclined relative to the vertical axis.

As used herein, the "horizontal axis" laundry treating appliance refers to a laundry treating appliance having a rotatable drum, perforated or imperforate, that holds laundry items and washes and/or dries the laundry items. In some horizontal axis laundry treating appliances, the drum rotates about a horizontal axis generally parallel to a surface that supports the laundry treating appliance. However, the rotational axis need not be horizontal. The drum can rotate about an axis inclined or declined relative to the horizontal axis. In horizontal axis laundry treating appliances, the clothes are lifted by the rotating drum and then fall in response to gravity to form a tumbling action. Mechanical energy is imparted to the clothes by the tumbling action formed by the repeated lifting and dropping of the clothes. Vertical axis and horizontal axis machines are best differentiated by the manner in which they impart mechanical energy to the fabric articles.

Regardless of the axis of rotation, a laundry treating appliance can be top-loading or front-loading. In a top-loading laundry treating appliance, laundry items are placed into the drum through an access opening in the top of a cabinet, while in a front-loading laundry treating appliance laundry items are placed into the drum through an access opening in the front of a cabinet. If a laundry treating appliance is a top-loading horizontal axis laundry treating appliance or a front-loading vertical axis laundry treating appliance, an additional access opening is located on the drum.

In more detail, the laundry treating appliance 10 can include a structural support assembly comprising a cabinet 14, which defines a housing and an interior, within which a laundry holding assembly resides. The cabinet 14 can be a housing having a chassis and/or a frame, to which decorative panels can or cannot be mounted, defining an interior, enclosing components typically found in a conventional laundry treating appliance, such as an automated clothes washer or dryer, which can include motors, pumps, fluid lines, controls, sensors, transducers, and the like. Such components will not be described further herein except as necessary for a complete understanding of the present disclosure.

The laundry holding assembly of the illustrated exemplary laundry treating appliance 10 can include a rotatable basket 30 having an open top 13 that can be disposed within the interior of the cabinet 14 and can at least partially define a rotatable treating chamber 32 for receiving laundry items for treatment and an access opening 15. The access opening 15 can provide access to the treating chamber 32. The treating chamber 32 is configured to receive a laundry load comprising laundry items for treatment, including, but not limited to, a hat, a scarf, a glove, a sweater, a blouse, a shirt, a pair of shorts, a dress, a sock, and a pair of pants, a shoe, an undergarment, and a jacket.

The open top 13 can be aligned with the access opening 15. A tub 34 can also be positioned within the cabinet 14 and can define an interior 24 within which the basket 30 can be positioned. The tub 34 can also at least partially define at least a portion of the treating chamber 32. The tub 34 can have a generally cylindrical side or tub peripheral wall 12 closed at its bottom end by a base 16 that can at least partially define a sump 60. The tub 34 can be at least partially aligned with the access opening 15 and the open top 13. In one example, the tub 34, the basket 30, along with the open top 13, and the access opening 15, can have central axes that are co-axial with one another, or with at least one of the other axes, such that a common central axis is formed.

The basket 30 can have a generally peripheral side wall 18, which is illustrated as a cylindrical side wall, closed at the basket end by a basket base 20 to further at least partially define the treating chamber 32. The basket 30 can be rotatably mounted within the tub 34 for rotation about a vertical basket axis of rotation and can include a plurality of perforations (not shown), such that liquid can flow between the tub 34 and the rotatable basket 30 through the perforations (not shown). While the illustrated laundry treating appliance 10 includes both the tub 34 and the basket 30, with the basket 30 at least partially defining the treating chamber 32, it is also within the scope of the present disclosure for the laundry holding assembly to include only one receptacle, such as the tub 34, without the basket 30, with the receptacle defining the laundry treating chamber 32 for receiving the load to be treated.

The cabinet 14 can further define a top wall or top panel 36, which can comprise a shroud 29 or to which the shroud 29 can be coupled. The shroud 29 can define at least a portion of the access opening 15, such that the shroud 29 can at least partially encircle the access opening 15. The shroud 29 can curve downwards toward the treating chamber 32 to direct laundry items into the basket 30. The shroud 29 can overlie a portion of the basket 30 such that the laundry items do not fall between the basket 30 and the tub 34.

A selectively openable closure or cover, illustrated herein as comprising a lid 28, can be movably mounted to or coupled to the cabinet 14 for selective movement between an opened position and a closed position, as shown, to selectively open and close the access opening 15, respectively, and to selectively provide access into the laundry treating chamber 32 through the access opening 15 of the basket 30. In one example, the lid 28 can be rotatable between the closed position and the opened position relative to the cabinet 14. By way of non-limiting example, the lid 28 can be hingedly coupled to the cabinet 14 for movement between the opened position and the closed position. In the closed position, the lid 28 can seal against at least one of the access opening 15, the top panel 36, or the shroud 29 and can at least partially confront the treating chamber 32 when the lid 28 closes the access opening 15. In the opened position, the lid 28 can be spaced apart from the access opening 15, the top panel 36, or the shroud 29 and can allow access to the top panel 36 and the access opening 15.

A clothes mover 100 can be rotatably mounted within the basket 30 to impart mechanical agitation and energy to a load of laundry items placed in the basket 30 or the treating chamber 32 according to a cycle of operation. The clothes mover 100 can be oscillated or rotated about its vertical axis of rotation during a cycle of operation in order to produce load motion effective to wash the load contained within the treating chamber 32. The clothes mover 100 can comprise a base or a first clothes mover, illustrated herein as an impeller 120, and a barrel, illustrated herein as an agitator 150. The agitator 150 as illustrated herein can comprise a vertically oriented agitator post that can be removably coupled with the impeller 120, the agitator 150 projecting vertically from the impeller 120 within the treating chamber 32 and toward the open top 13 of the basket 30. In this aspect of the disclosure, the clothes mover 100 can be formed by coupling an additional component, the agitator 150, to the impeller 120 and can be thought of as forming a second clothes mover.

The agitator 150 can include any configuration of vanes, blades, or other structural features for imparting mechanical energy to laundry items during a cycle of operation. Generally, the vertical extent of the agitator 150, combined with vane, blade, or other structural features, can impart the mechanical action to laundry items, which provides improved cleaning performance and can be suitable for particularly soiled loads. Other exemplary types of clothes movers include, but are not limited to, an agitator alone, a wobble plate, and a hybrid impeller/agitator.

The basket 30 and the clothes mover 100 can be driven, such as to rotate within the tub 34, by a drive assembly 40 that includes a motor 41, which can include a gear case, operably coupled with the basket 30 and clothes mover 100. The motor 41 can be a brushless permanent magnet (BPM) motor having a stator (not shown) and a rotor (not shown). Alternately, the motor 41 can be coupled to the basket 30 through a belt and a drive shaft to rotate the basket 30, as is known in the art. Other motors, such as an induction motor or a permanent split capacitor (PSC) motor, can also be used. The motor 41 can rotate the basket 30 at various speeds in either rotational direction about the vertical axis of rotation during a cycle of operation, including at a spin speed wherein a centrifugal force at the inner surface of the basket side wall 18 is 1 g or greater. Spin speeds are commonly known for use in extracting liquid from the laundry items in the basket 30, such as after a wash or rinse step in a treating cycle of operation. A loss motion device or clutch (not shown) can be included in the drive assembly 40 and can selectively operably couple the motor 41 with either the basket 30 and/or the clothes mover 100.

A suspension assembly 22 can dynamically hold the tub 34 within the cabinet 14. The suspension assembly 22 can dissipate a determined degree of vibratory energy generated by the rotation of the basket 30 and/or the clothes mover 100 during a treating cycle of operation. Together, the tub 34, the basket 30, and any contents of the basket 30, such as liquid and laundry items, define a suspended mass for the suspension assembly 22.

The laundry treating appliance 10 can further include a liquid supply assembly to provide liquid, such as water or a combination of water and one or more wash aids, such as detergent, into the treating chamber 32 for use in treating laundry items during a cycle of operation. The liquid supply assembly can include a water supply 44 configured to supply hot or cold water. The water supply 44 can include a hot water inlet 45 and a cold water inlet 46. A valve assembly can include a hot water valve 48, a cold water valve 50, and various conduits 52, 58 for selectively distributing the water supply 44 from the hot water and cold water inlets 45, 46. The valves 48, 50 are selectively openable to provide water from a source of water, such as from a household water supply (not shown) to the conduit 52. A second water conduit, illustrated as the water inlet 58, can also be fluidly coupled with the conduit 52 such that water can be supplied directly to the treating chamber 32 through the open top of the basket 30. The water inlet 58 can be configured to dispense water, and optionally treating chemistry, into the tub 34 in a desired pattern and under a desired amount of pressure. For example, the water inlet 58 can be configured to dispense a flow or stream of treating chemistry or water into the tub 34 by gravity, i.e., a non-pressurized stream. The valves 48, 50 can be opened individually or together to provide a mix of hot and cold water at a selected temperature. While the valves 48, 50 and conduit 52 are illustrated exteriorly of the cabinet 14, it will be understood that these components can be internal to the cabinet 14.

A treating chemistry dispenser 54 can be provided for dispensing treating chemistry to the basket 30 for use in treating the laundry items according to a cycle of operation, either directly or mixed with water from the water supply 44. The treating chemistry dispenser 54 can be a single use dispenser, a bulk dispenser, or a combination of or an integrated single use and bulk dispenser, in non-limiting examples, and is fluidly coupled to the treating chamber 32. While the treating chemistry dispenser 54 is illustrated herein as being provided at the top panel 36 or the shroud 29, it will be understood that other locations for the treating chemistry dispenser 54 can be contemplated, such as at a different location within the cabinet 14. Further, the treating chemistry dispenser 54 can be provided in a drawer configuration or as at least one reservoir fluidly coupled to the treating chamber 32.

The treating chemistry dispenser 54 can include means for supplying or mixing detergent to or with water from the water supply 44. Alternatively, water from the water supply 44 can also be supplied to the tub 34 through the treating chemistry dispenser 54 without the addition of a detergent. The treating chemistry dispenser 54 can be configured to dispense the treating chemistry or water into the tub 34 in a desired pattern and under a desired amount of pressure. For example, the treating chemistry dispenser 54 can be configured to dispense a flow or stream of treating chemistry or water into the tub 34 by gravity, i.e., a non-pressurized stream.

The treating chemistry dispenser 54 can include multiple chambers or reservoirs fluidly coupled to the treating chamber 32 for receiving doses of different treating chemistries. The treating chemistry dispenser 54 can be implemented as a dispensing drawer that is slidably received within the cabinet 14, or within a separate dispenser housing which can be provided in the cabinet 14. The treating chemistry dispenser 54 can be moveable between a fill position, where the treating chemistry dispenser 54 is exterior to the cabinet 14 and can be filled with treating chemistry, and a dispense position, where the treating chemistry dispenser 54 is interior of the cabinet 14.

Non-limiting examples of treating chemistries that can be dispensed by the dispensing assembly during a cycle of operation include one or more of the following: water, detergents, surfactants, enzymes, fragrances, stiffness/sizing agents, wrinkle releasers/reducers, softeners, antistatic or electrostatic agents, stain repellents, water repellents, energy reduction/extraction aids, antibacterial agents, medicinal agents, vitamins, moisturizers, shrinkage inhibitors, and color fidelity agents, and combinations thereof. The treating chemistries can be in the form of a liquid, powder, or any other suitable phase or state of matter.

Additionally, the liquid supply assembly and treating chemistry dispenser 54 can differ from the configuration shown, such as by inclusion of other valves, conduits, wash aid dispensers, heaters, sensors, such as water level sensors and temperature sensors, and the like, to control the flow of treating liquid through the laundry treating appliance 10 and for the introduction of more than one type of detergent/wash aid.

A liquid recirculation and drain assembly can be provided with the laundry treating appliance 10 for recirculating liquid from within the laundry holding assembly and draining liquid from the laundry treating appliance 10. Liquid supplied to the tub 34 or into the treating chamber 32 through the water inlet 58 and/or the treating chemistry dispenser 54 typically enters a space between the tub 34 and the basket 30 and can flow by gravity to the sump 60. More specifically, the sump 60 can be located in and formed in part by the bottom of the tub 34 and the liquid recirculation assembly can be configured to recirculate treating liquid from the sump 60 onto the top of a laundry load located in the treating chamber 32.

A pump 62 can be housed below the tub 34 and can have an inlet fluidly coupled with the sump 60 and an outlet configured to fluidly couple and to direct liquid to either or both a household drain 64, which can drain the liquid from the laundry treating appliance 10, or a recirculation conduit 66. In this configuration, the pump 62 can be used to drain or recirculate wash water in the sump 60. As illustrated, the recirculation conduit 66 can be fluidly coupled with the treating chamber 32 such that it supplies liquid from the recirculation conduit 66 into the open top of the basket 30. The recirculation conduit 66 can introduce the liquid into the basket 30 in any suitable manner, such as by spraying, dripping, or providing a steady flow of liquid. In this manner, liquid provided to the tub 34, with or without treating chemistry can be recirculated into the treating chamber 32 for treating the laundry within. The liquid recirculation and drain assembly can include other types of recirculation assemblies.

It is noted that the illustrated drive assembly, suspension assembly, liquid supply assembly, recirculation and drain assembly, and dispensing assembly are shown for exemplary purposes only and are not limited to the assemblies shown in the drawings and described above. For example, the liquid supply and recirculation and pump assemblies can differ from the configuration shown in FIG. 1, such as by inclusion of other valves, conduits, sensors (such as liquid level sensors and temperature sensors), and the like, to control the flow of liquid through the laundry treating appliance 10 and for the introduction of more than one type of treating chemistry. For example, the liquid supply assembly can be configured to supply liquid into the interior of the basket 30 or into the interior of the tub 34 not occupied by the basket 30, such that liquid can be supplied directly to the tub 34 without having to travel through the basket 30. In another example, the liquid supply assembly can include a single valve for controlling the flow of water from the household water source. In another example, the recirculation and pump assembly can include two separate pumps for recirculation and draining, instead of the single pump 62 as previously described.

The laundry treating appliance 10, and specifically the liquid supply and/or recirculation and drain assemblies, can be provided with a heating assembly (not shown), which can include one or more devices for heating laundry and/or to heat liquid provided to the treating chamber 32 as part of a cycle of operation, such as, for example, a steam generator, which can be any suitable type of steam generator, such as a flow through steam generator or a tank-type steam generator, and/or a sump heater. Alternatively, the sump heater can be used to generate steam in place of or in addition to the steam generator. In one example, the heating assembly can include a heating element provided in the sump 60 to heat liquid that collects in the sump 60. Alternatively, the heating assembly can include an in-line heater that heats the liquid as it flows through the liquid supply, dispensing and/or recirculation assemblies.

The laundry treating appliance 10 can further include a control assembly, illustrated herein as a controller 70, for controlling the operation of the laundry treating appliance 10 and coupled with various working components of the laundry treating appliance 10 to control the operation of the working components and to implement one or more treating cycles of operation. The control assembly can include the controller 70 located within the cabinet 14 and a user interface 26 that can be operably coupled with the controller 70. The user interface 26 can provide an input and output function for the controller 70.

The user interface 26 can include one or more knobs, dials, switches, displays, touch screens and the like for communicating with the user, such as to receive input and provide output. For example, the displays can include any suitable communication technology including that of a liquid crystal display (LCD), a light-emitting diode (LED) array, or any suitable display that can convey a message to the user. The user can enter different types of information including, without limitation, cycle selection and cycle parameters, such as cycle options. Other communications paths and methods can also be included in the laundry treating appliance 10 and can allow the controller 70 to communicate with the user in a variety of ways. For example, the controller 70 can be configured to send a text message to the user, send an electronic mail to the user, or provide audio information to the user either through the laundry treating appliance 10 or utilizing another device such as a mobile phone.

The controller 70 can include the machine controller and any additional controllers provided for controlling any of the components of the laundry treating appliance 10. For example, the controller 70 can include the machine controller and a motor controller. Many known types of controllers can be used for the controller 70. It is contemplated that the controller is a microprocessor-based controller that implements control software and sends/receives one or more electrical signals to/from each of the various working components to implement the control software. As an example, proportional control (P), proportional integral control (PI), and proportional derivative control (PD), or a combination thereof, a proportional integral derivative control (PID), can be used to control the various components of the laundry treating appliance 10.

Figure 2:
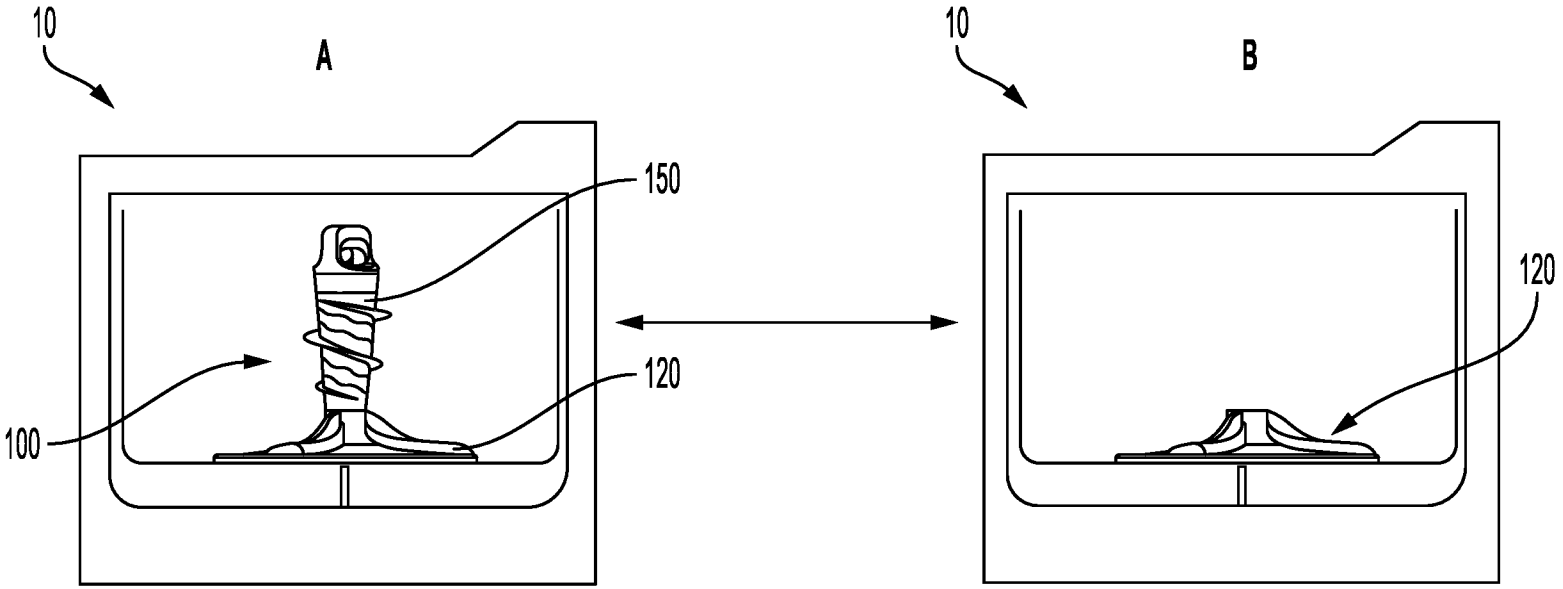
FIG. 2 is a simplified cross-sectional view of the laundry treating appliance and the clothes mover of FIG. 1 with the agitator shown in attached and detached configurations.

Referring now to FIG. 2, the laundry treating appliance 10 as described herein allows the user to customize the laundry treating appliance 10 for treating the laundry load or loads to be treated. For example, the laundry treating appliance 10 can be utilized and operated with one of at least two different configurations, each utilizing a different type of clothes mover 100, the configurations selectable based on the user's treatment needs. Aspects of the laundry treating appliance 10 described herein allow the user to selectively assemble and disassemble the agitator 150, which can be thought of as forming a second clothes mover, and the impeller 120, which can be thought of as a first clothes mover, to configure the laundry treating appliance 10 into one of the two configurations. The user can customize the clothes mover 100 based on the user's personal preferences, based on the amount and/or type of mechanical action implemented by the different configurations of the clothes mover 100, and/or based on characteristics of the laundry items to be treated, non-limiting examples of which include an amount of laundry items to be treated, a size of the laundry item(s) to be treated, soil level of the laundry items, an amount and/or type of mechanical energy to be applied to the laundry items, the type of fabric of the laundry items (e.g., whether the laundry is delicate or rugged), and a fill level of liquid during treatment.

The laundry treating appliance 10 can be configured in a first configuration, illustrated by way of example as a configuration A as shown, and also as illustrated in FIG. 1, by assembling the agitator 150 with the impeller 120 within the laundry treating appliance 10. In the configuration A, the user can elect to use the clothes mover 100 that includes the agitator 150 for treating a laundry load. Such a configuration as configuration A can be useful if the user wishes to implement a treatment mode using agitator-based washing, such as for imparting significant or high quantities of mechanical action onto particularly soiled laundry items, or if the user wishes to perform deep water washing, or based on any other user preference for the clothes mover 100 and the agitator 150, such as a personal preference.

In another example, the laundry treating appliance 10 can also be configured in a second configuration, illustrated by way of example as a configuration B as shown, by assembling only the impeller 120 within the laundry treating appliance 10 and decoupling or removing the agitator 150. In the configuration B, the user elects to use the clothes mover 100 with the lower profile impeller 120 and that does not include the agitator 150 or any similar agitator post. Such a configuration as configuration B can be useful if the user wishes to implement a treatment mode using impeller-based washing, such as for low water washing, for gentler washing, wherein a lower mechanical action is imparted to the laundry items, or for washing bulky items such as blankets or comforters that could tangle around the agitator 150. Larger, bulky laundry items generally do not fit well in the basket 30 when a vertical-oriented agitator-type clothes mover 100, such as configuration A including the agitator 150, is present. Thus, the user can selectively configure the laundry treating appliance 10 to utilize the only the impeller 120 as illustrated in the configuration B, without the agitator 150 extending upward into the treating chamber 32, for use in treating large and/or bulky loads or to implement a low water treatment mode, for example, or based on another preference of the user, such as a personal preference.

The components of the laundry treating appliance 10 are configured to allow the user to configure and re-configure the laundry treating appliance 10 into either of the agitator 150 configuration A and the impeller 120 configuration B as desired. The user can select either of the configurations A or B based on personal preference of utilizing the particular type of clothes mover 100 of configuration A or B over the other, the desired cycle of operation to be implemented, and/or characteristics of the laundry items or the laundry load.

Turning now to the process or method of configuring or re-configuring the clothes mover 100, to operate the laundry treating appliance 10 and to utilize configuration A in which the agitator 150 is present in the laundry treating appliance 10, the user can assemble the agitator 150 in the laundry treating appliance 10, such as by coupling or assembling the agitator 150 to the impeller 120 to form the clothes mover 100. The user can then utilize the laundry treating appliance 10 to implement a cycle of operation on a load of laundry in a conventional manner. When the agitator 150 is configured to be supported at least in part by the impeller 120, configuration A will include the impeller 120. Optionally, if the agitator 150 does not require the impeller 120 for support, such as when the agitator 150 can be supported by the basket 30, configuration A does not have to include the impeller 120. In this alternative configuration A, the impeller 120 does not have to be present and the clothes mover 100 can be utilized with just the agitator 150.

To operate the laundry treating appliance 10 and to utilize configuration B in which only the impeller 120 is present in the laundry treating appliance 10, the removable agitator 150 is disassembled or uncoupled from the impeller 120 by the user and removed from the laundry treating appliance 10, and the impeller 120 is assembled within the basket 30. To assemble the impeller 120 within the basket 30, the agitator 150 can be configured to separate from the impeller 120 while the impeller 120 remains coupled with the drive assembly 40 and the motor 41. The user can then utilize the laundry treating appliance 10 to implement a cycle of operation on a load of laundry in a conventional manner. The impeller 120 is configured to operate as the clothes mover 100 of configuration B, that is different than the clothes mover 100 of configuration A and independent of the agitator 150, during a cycle of operation. In this manner, the laundry treating appliance 10 can be selectively re-configured by the user between the first and second configurations as illustrated to utilize two different clothes movers 100.

Further, to configure or re-configure the laundry treating appliance 10 from the first configuration, configuration A, to the second configuration, configuration B, the user removes or decouples the agitator 150 and sets it aside. Optionally, the laundry treating appliance 10 can be configured to facilitate storage of the removable agitator 150 when not in use. For example, the laundry treating appliance 10 can include a storage element that suspends the removable agitator 150 from the laundry treating appliance 10, such as a hook, clamp, hanger, or suspending rod. In another example, the storage element can be in the form of a shelf, drawer, or cavity configured to support the removable agitator 150. In another aspect of the disclosure, a companion laundry dryer or laundry module can include the storage element configured to store the removable agitator 150.

Figure 3:
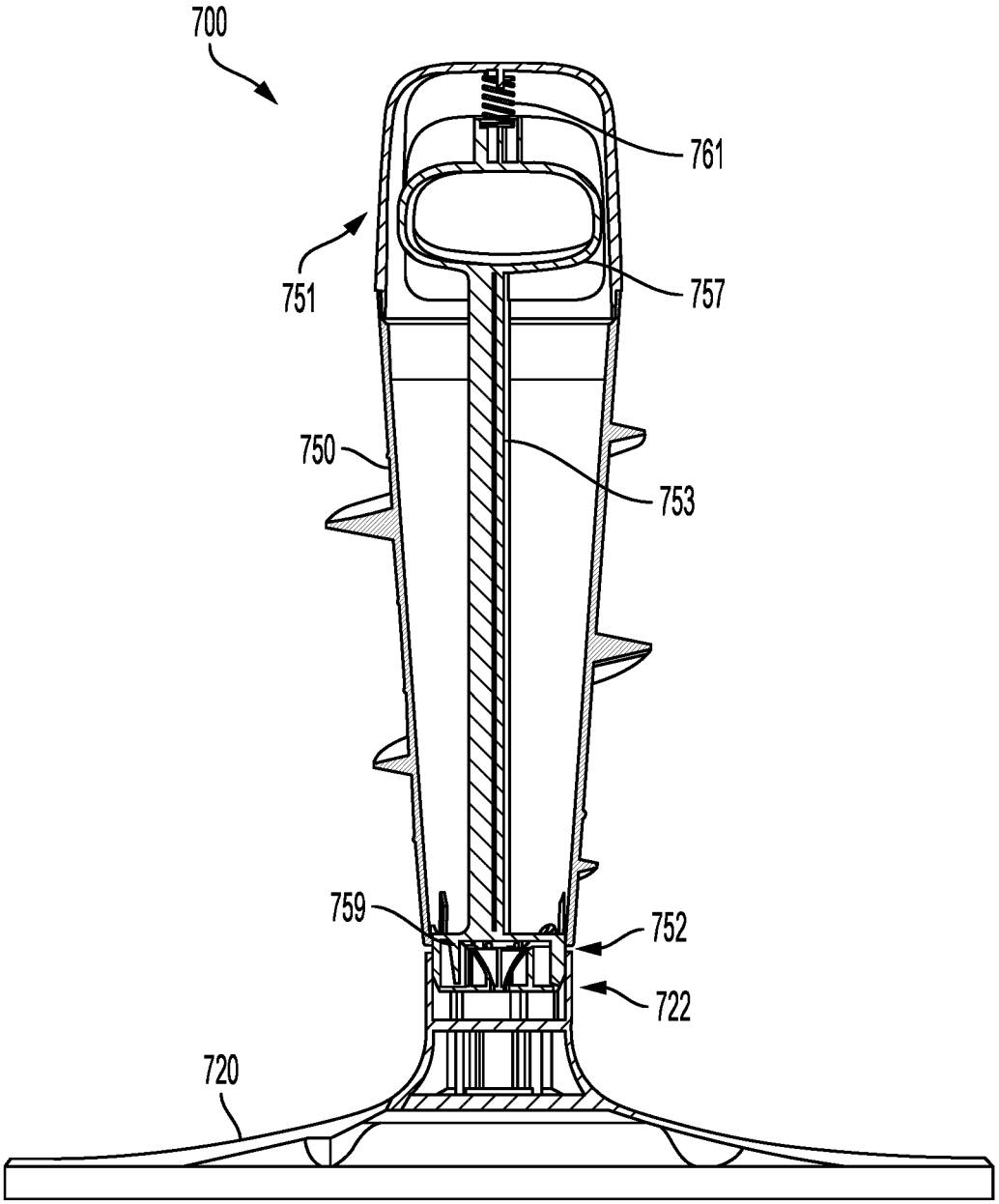
FIG. 3 is a perspective cross-sectional view of an agitator coupling to an impeller for use with the clothes mover and laundry treating appliance of FIG. 1.

Referring now to FIG. 3, an agitator 750 is coupled to an impeller 720 to form the clothes mover 700 using a bayonet mount-type connection. The agitator 750 includes a grip portion, illustrated herein as a handle portion 751 at an upper end of the agitator 750. The handle portion 751 can facilitate insertion, removal, and storage of the agitator 750 by the user by giving the user a convenient handle to grip onto and to rotate the agitator 750 as needed. The agitator 750 further includes a handle pull locking post 753 provided within the interior of the agitator 750, such that the locking post 753 is nested within the agitator 750. The locking post 753 can include a handle pull portion 757 positioned such that the user can grip the handle portion 751 of the agitator 750 and the handle pull portion 757 of the locking post 753 at the same time. The locking post 753 further defines at least one pin 759 protruding downwardly from a lower end of the locking post 753. The at least one pin 759 can be thought of as forming a portion of the first connector 752. The locking post 753 can be movable within and relative to the agitator 750, for example such that the locking post 753 is vertically slidable within and relative to the agitator 750 between a lower, locking position and a raised position. A biasing element, illustrated herein as a handle pull spring 761 that extends between the handle portion 751 and the handle pull portion 757 so as to bias the locking post 753 downwardly from the handle portion 751 when not compressed by the user.

Figure 4:
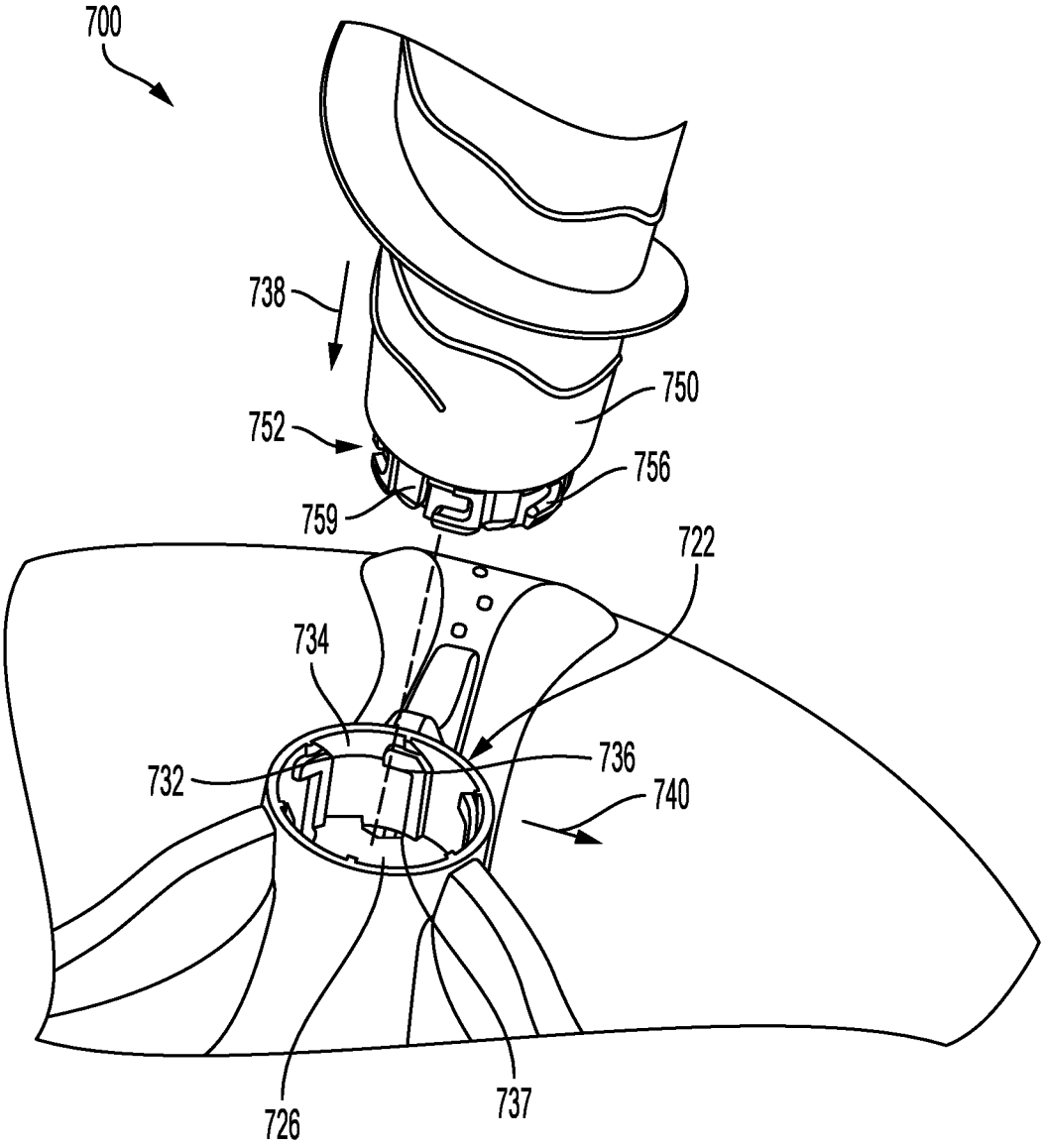
FIG. 4 is a perspective view of the agitator coupling to the impeller of FIG. 3.

FIG. 4 illustrates the second connector 722 including at least one channel 732 configured to receive at least one pin 756 carried by the first connector 752. The at least one pin 759, illustrated herein as a plurality of pins 759, can protrude downwardly from the locking post 753, and thus also from the agitator 750, adjacent the at least one pin 756. In one example, the pins 759 and the pins 756 can be provided in an alternating manner, such that the pins 759 are received between the pins 756. The second connector 722 can further define at least one locking opening 737, which can be provided in a bottom wall of the second connector 722. The second connector 722 optionally includes a biasing element, such as at least one spring, within the socket 726 which is compressed within the socket 726 when the agitator 750 is coupled with the impeller 720, as illustrated in FIG. 3.

Figure 20:
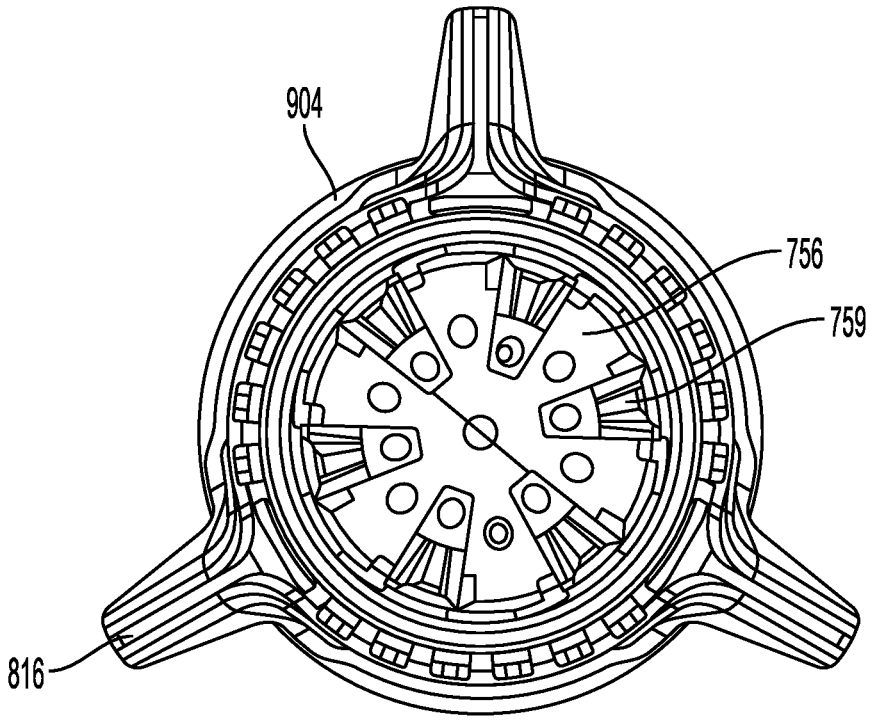
FIG. 20 is a bottom view of the removable agitator of FIG. 16.

To assemble the clothes mover 700, the agitator 750 is aligned with the impeller 720 such that the at least one pin 756 is aligned with at least one opening 734 of the channels 732. It is contemplated that the user can grip the agitator 750 by the handle portion 751 during insertion of the agitator 750 into the impeller 720. Further, the user can also grip the handle pull portion 757 of the locking post 753 at the same time, compressing the handle pull spring 761 and holding the locking post 753 in the raised position. The agitator 750 is moved toward the impeller 720, as illustrated by arrow 738, to insert the first connector 752 into the second connector 722. As the first connector 752 is inserted into the second connector 722, the pin 756 travels into the channel 732. The locking post 753 can be maintained in the raised position by the grip of the user against the handle pull portion 757 and the handle portion 751. The agitator 750 is then rotated, as illustrated by arrow 740, to move the pin 756 into a lock portion 736 of the channel 732, as illustrated in FIG. 20. In one example, the at least one locking opening 737 can be positioned beneath the lock portion 736 of the channel 732. Further, the first and second connectors 752, 722 can be positioned and sized such that the locking post 753 must be held in the raised position to prevent the pins 759 from protruding downwardly beyond the pins 756 and in order for the agitator 750 to be rotated as illustrated by arrow 740.

Figure 5:
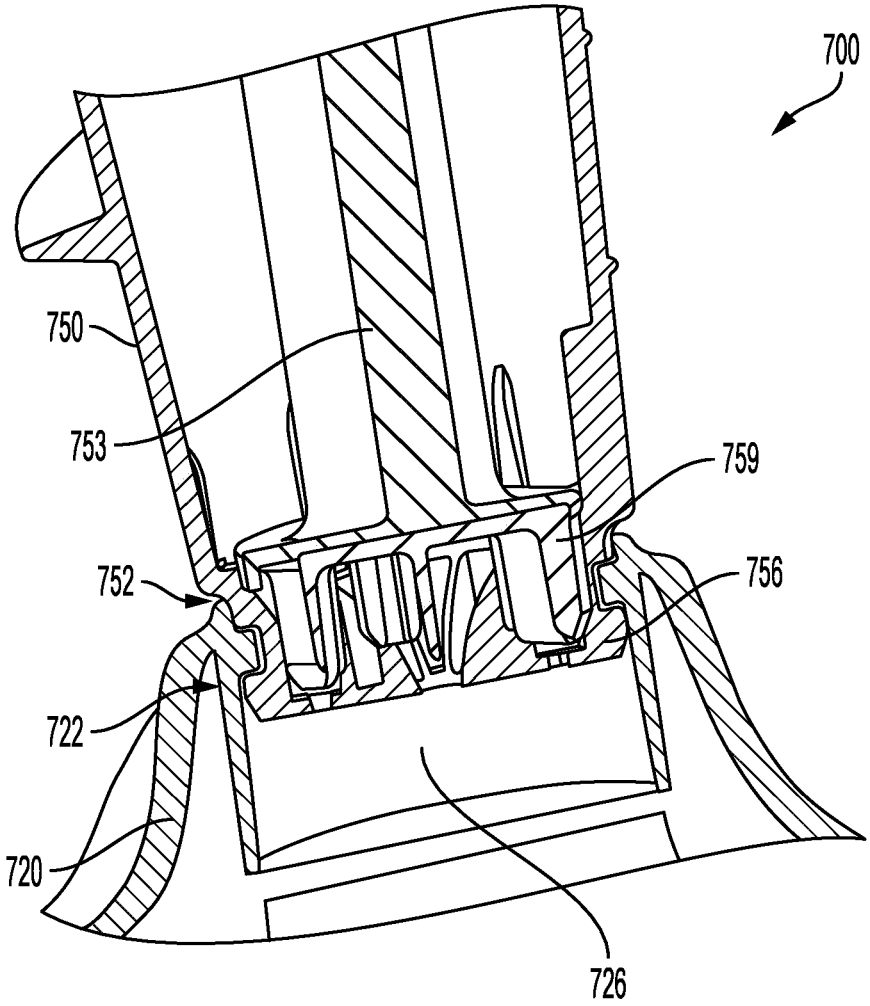
FIG. 5 is a cross-sectional view of the agitator coupling to the impeller of FIG. 3 in a first position.

In FIG. 5, the agitator 750 is coupled with the impeller 720, with the pins 756 engaging the lock portion 736 of the channel 732. The locking post 753 is still provided in the raised position, such that the pins 759 do not exceed downwardly beyond the pins 756. When the agitator 750 is coupled with the impeller 720, the spring (not shown), or other biasing element, biases the agitator 750 away from the impeller 720, facilitating maintaining the pin 756 in the lock portion 736. The spring (not shown) applies a force that presses the agitator 750, and thus the pin 756, upward, which presses the pin 756 upwardly against the wall forming the lock portion 736. Biasing the pin 756 against the wall of the lock portion 736 can inhibit unintended rotation of the agitator 750 relative to the impeller 720 during a cycle of operation into a position in which the pin 756 is aligned with the channel opening 734, which could result in unintended uncoupling of the agitator 750 from the impeller 720.

Figure 6:
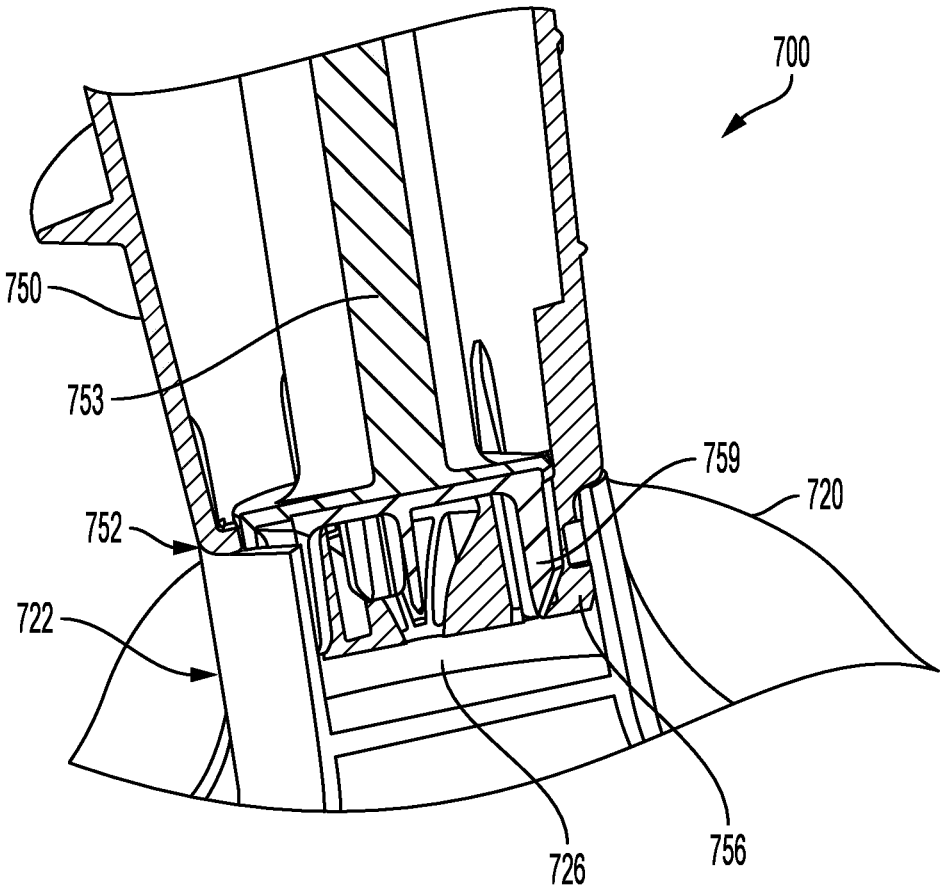
FIG. 6 is a cross-sectional view of the agitator coupling to the impeller of FIG. 3 in a second position.

Referring now to FIG. 6, and in order to further inhibit unintended rotation of the agitator 750 relative to the impeller 720 during a cycle of operation, once the agitator 750 has been rotated to move the pins 756 into the lock portion 736, the pins 759 of the locking post 753 overlie and are aligned with the locking openings 737. The user can release the handle pull portion 757 and the handle portion 751, allowing the handle pull spring 761 to bias the locking post 753 downwardly. As the handle pull spring 761 biases the locking post 753 downwardly, the pins 759 are moved downwardly to be inserted into and received within the locking openings 737. When the pins 759 are received within the locking openings 737, unintended rotation of the agitator 750 relative to the impeller 720 during a cycle of operation is inhibited. Further, the engagement between the pins 756 and the lock portion 736 prevents unintended vertical movement of the agitator 750 relative to the impeller 720.

To uncouple the agitator 750 from the impeller 720, the user can again grip the agitator 750 by the handle portion 751 and can also grip the handle pull portion 757 of the locking post 753 and compress the handle pull spring 761 to hold the locking post 753 in the raised position, withdrawing the pins 759 from the locking openings 737, to permit rotational movement of the agitator 750. The agitator 750 can then be rotated in the opposite direction of arrow 740 of FIG. 5 until the pins 756 are no longer aligned with the lock portion 736 and are instead aligned with the at least one opening 734 of the channels 732. When the pins 756 are aligned with the at least one opening 734, the agitator 750 can be withdrawn in the opposite direction of arrow 738 of FIG. 4.

Figure 7:
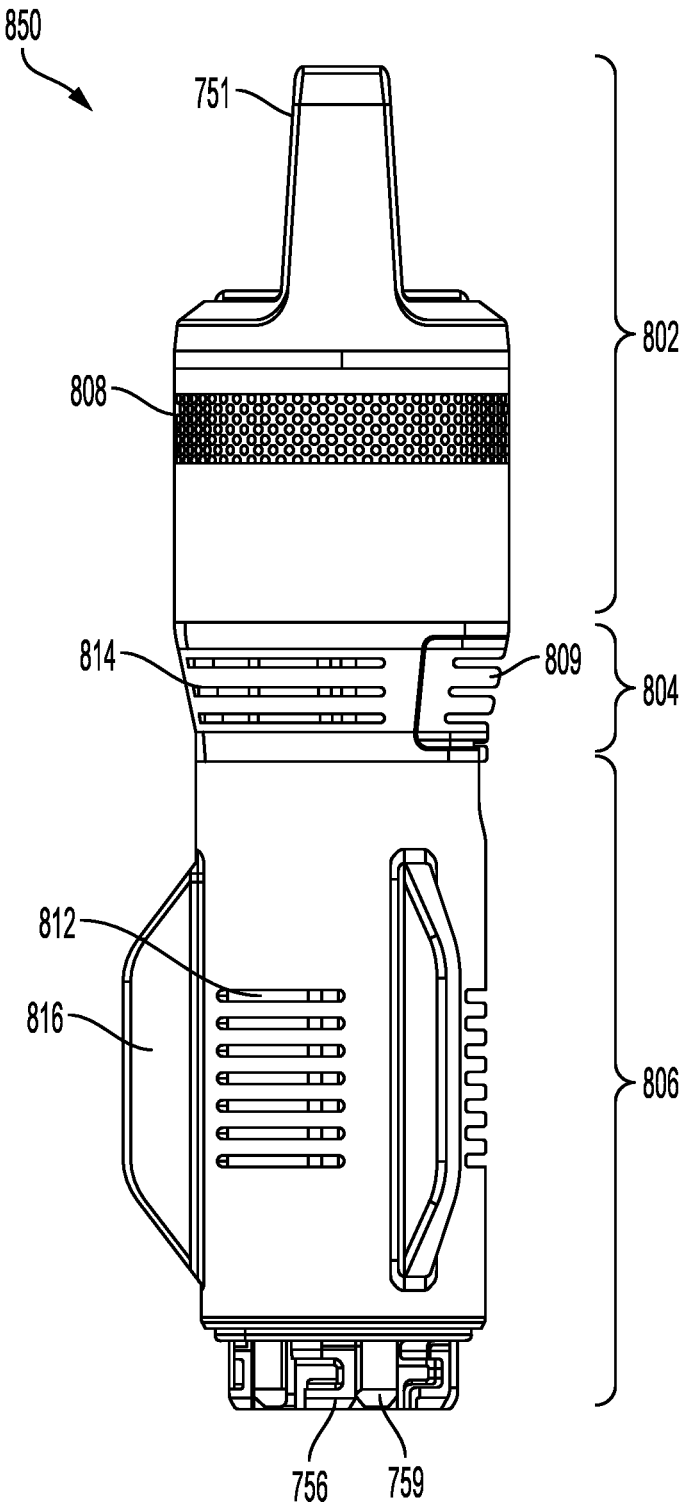
FIG. 7 is a side view of a removable agitator in a first radial position about its longitudinal axis.
Figure 8:
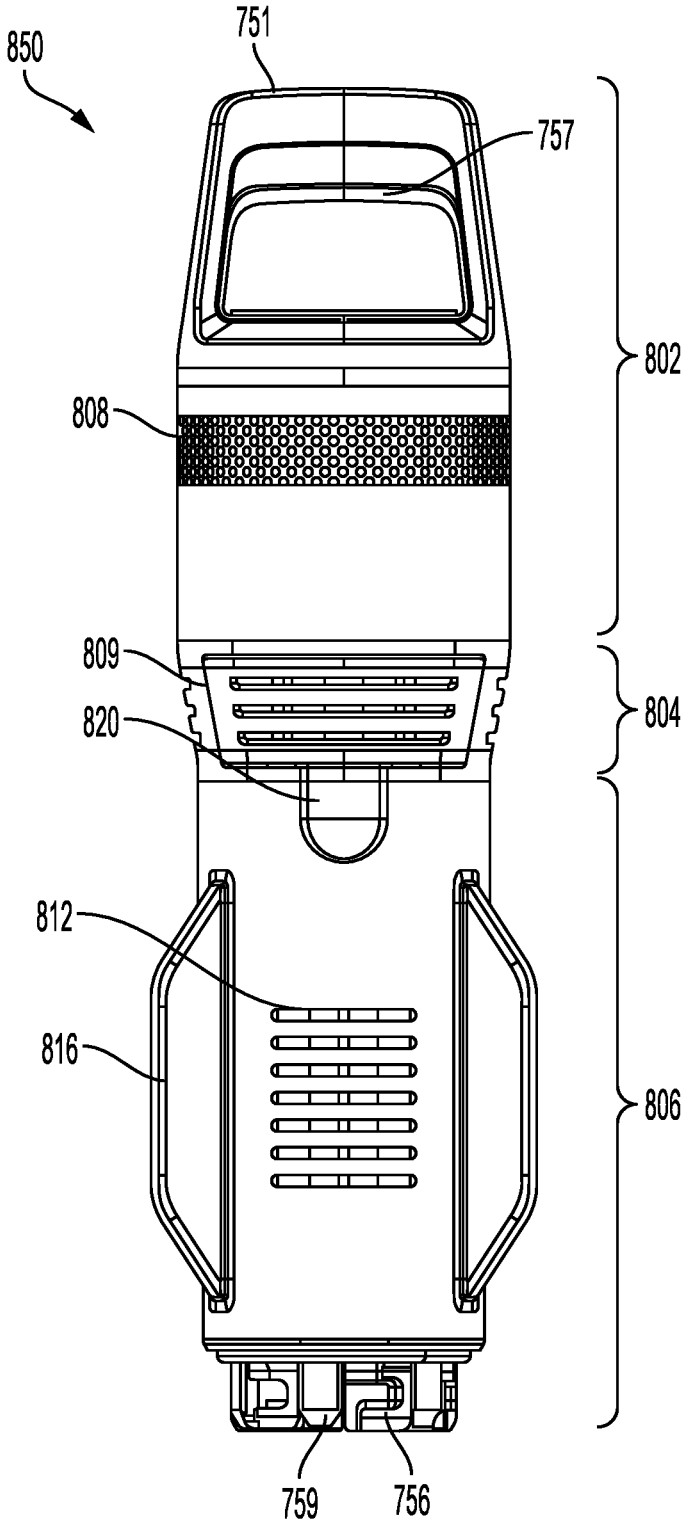
FIG. 8 is a side view of the removable agitator of FIG. 7 in a second radial position about its longitudinal axis.
Figure 9:
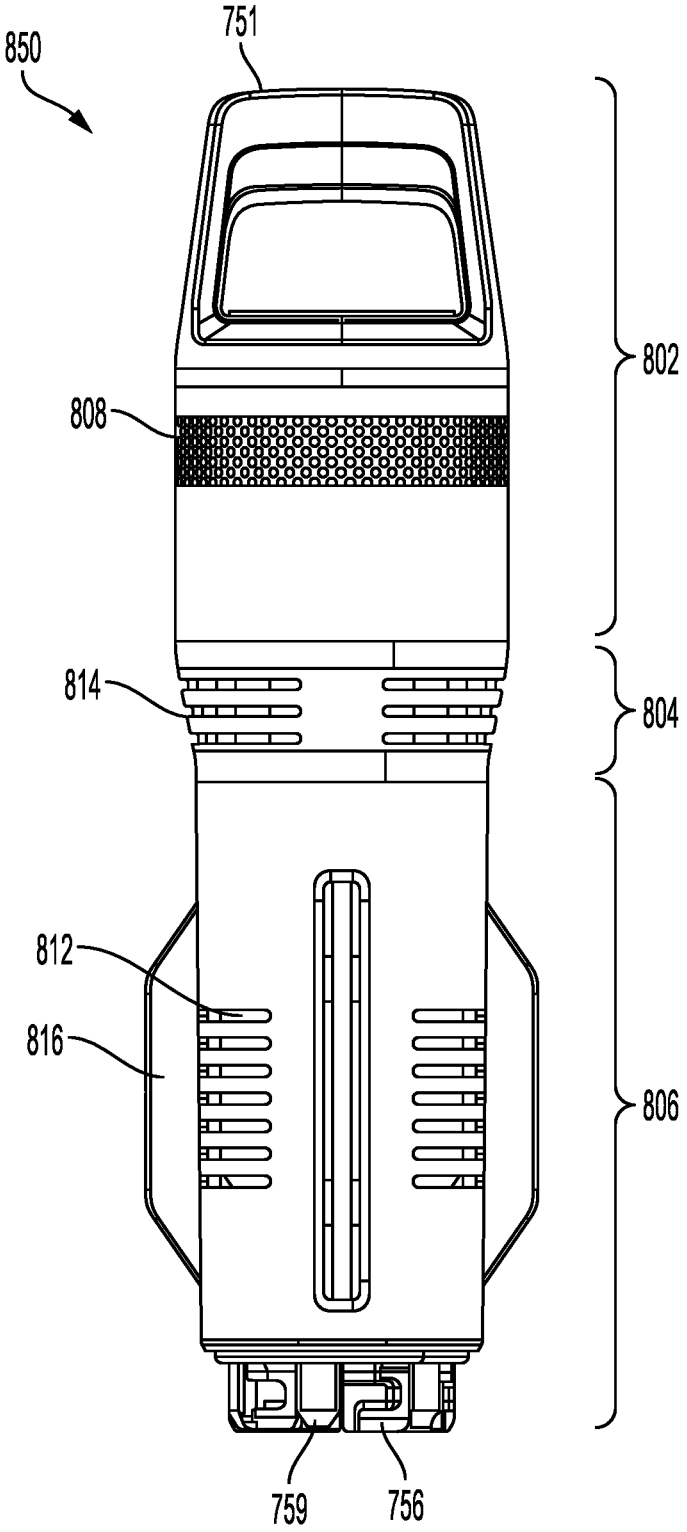
FIG. 9 is a side view of the removable agitator of FIG. 7 in a third radial position about its longitudinal axis.
Figure 10:
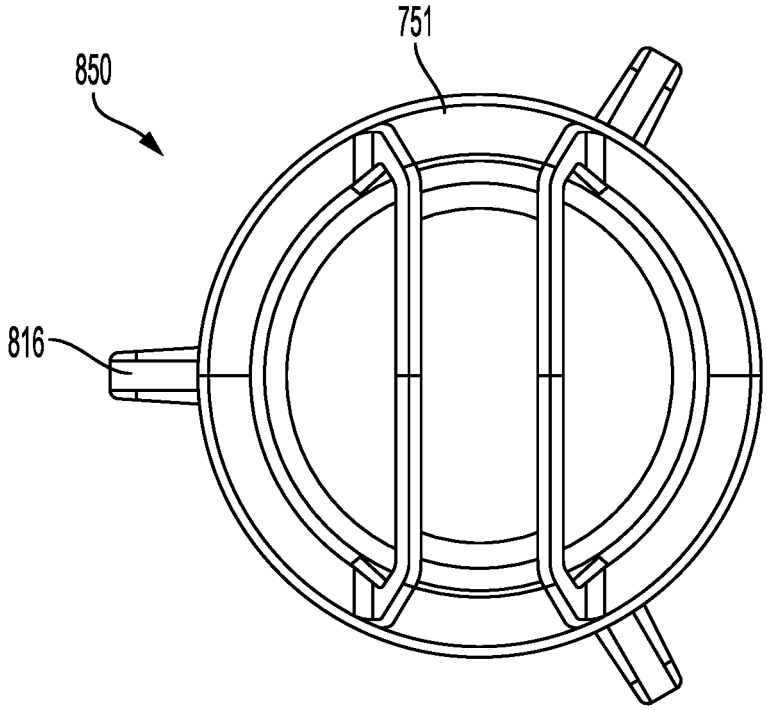
FIG. 10 is a top view of the removable agitator of FIG. 7.
Figure 11:
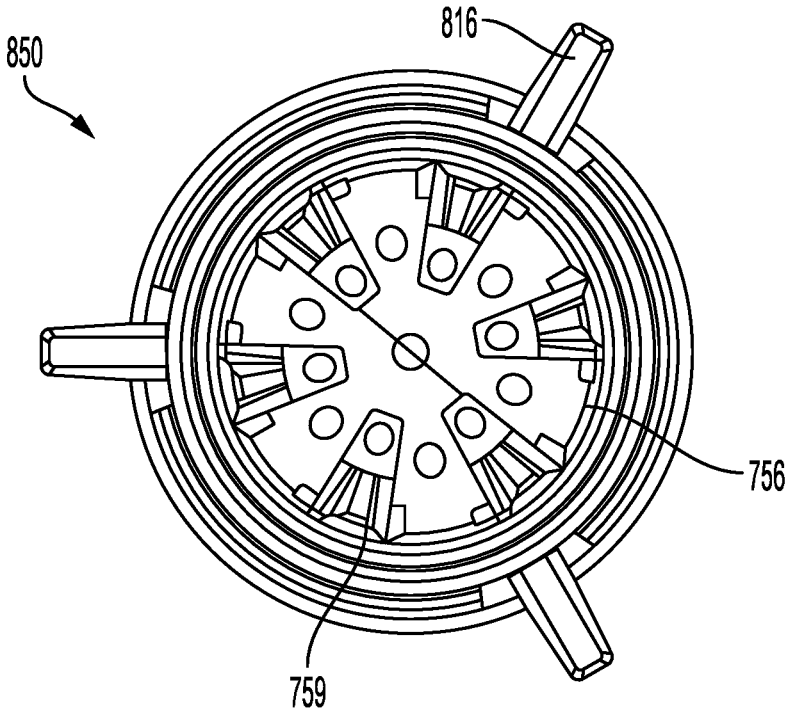
FIG. 11 is a bottom view of the removable agitator of FIG. 7.
Figure 12:
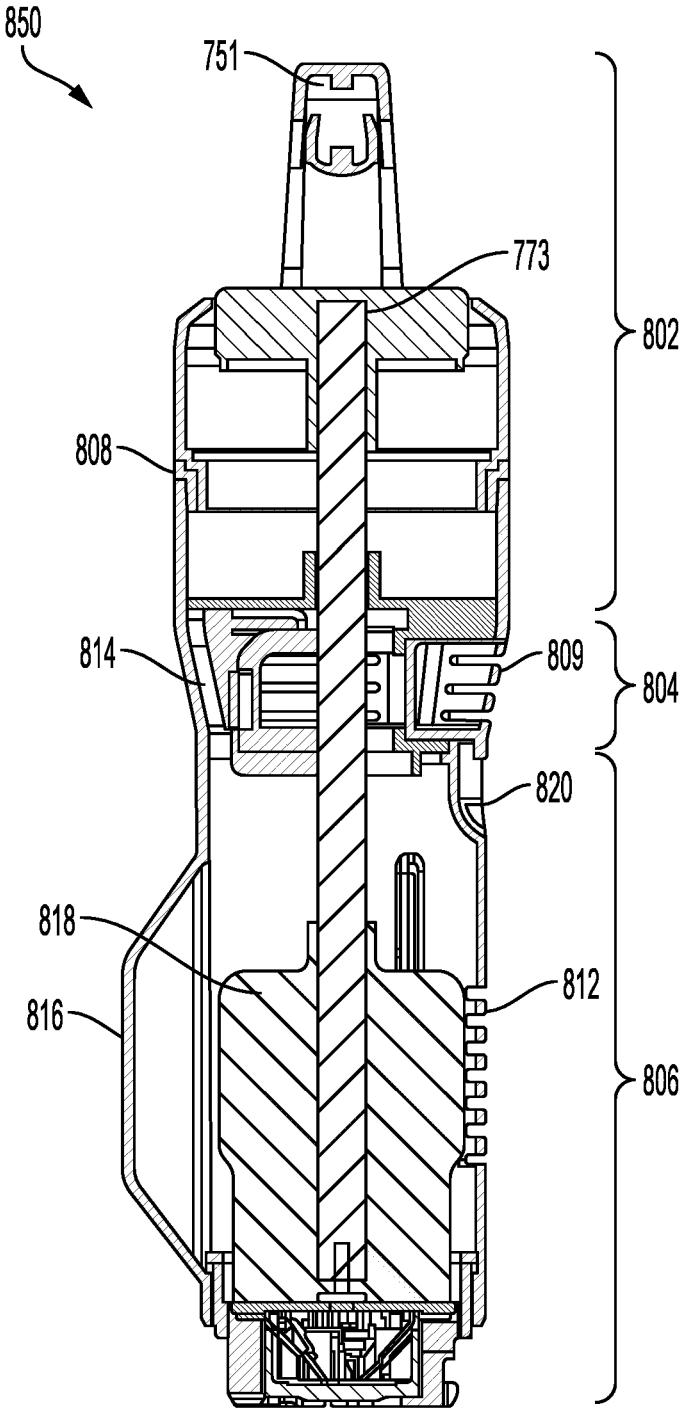
FIG. 12 is a side cross-sectional view of the removable agitator of FIG. 7 in the first radial position.
Figure 13:
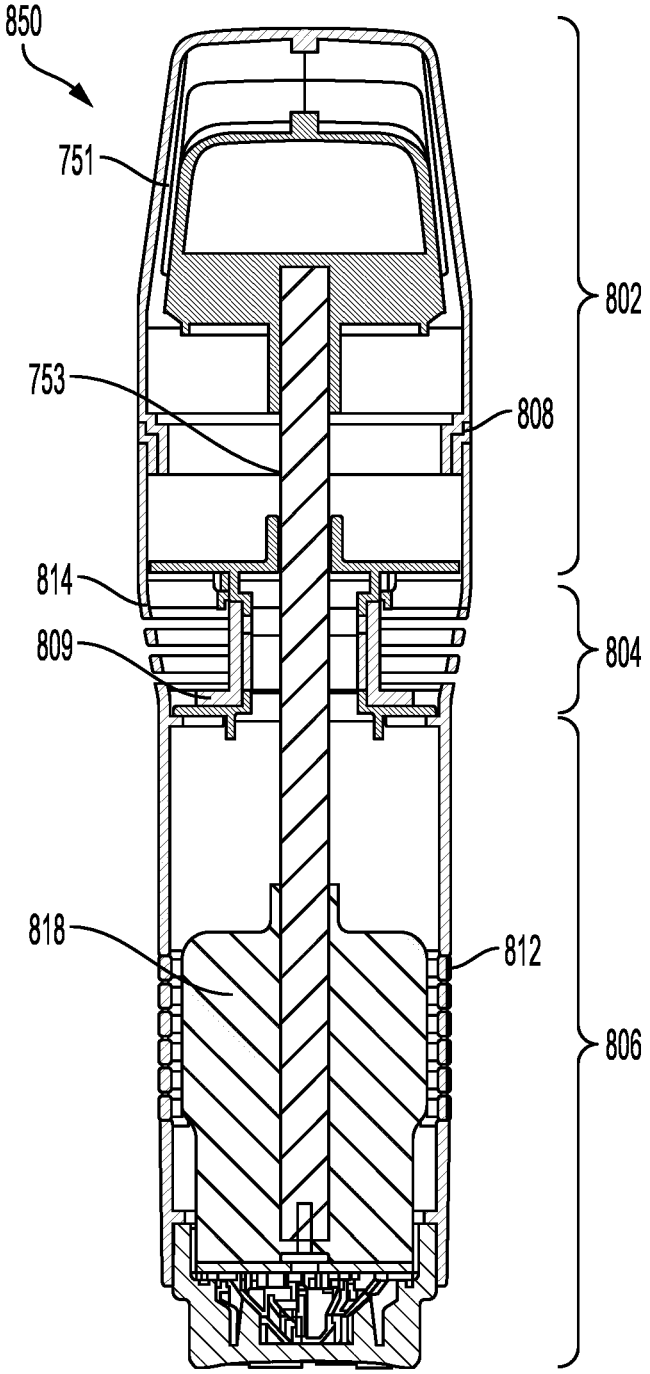
FIG. 13 is a side cross-sectional view of the removable agitator of FIG. 9 in the first radial position.

FIGS. 7-15 describe an embodiment of the removable agitator 850 having internal filtration capabilities. FIG. 7 is a side view of the removable agitator 850 in a first radial position about its longitudinal axis. FIG. 8 is a side view of the removable agitator 150 of FIG. 7 in a second radial position about its longitudinal axis. FIG. 9 is a side view of the removable agitator 150 of FIG. 7 in a third radial position about its longitudinal axis. FIG. 10 is a top view of the removable agitator 150 of FIG. 7. FIG. 11 is a bottom view of the removable agitator 150 of FIG. 7. FIG. 11 is a bottom view of the removable agitator 150 of FIG. 7. FIG. 12 is a side cross-sectional view of the removable agitator of FIG. 7 in the first rotation. FIG. 13 is a side cross-sectional view of the removable agitator of FIG. 9 in the first rotation;

The agitator 850 may comprise a plurality of selectively attachable and detachable sections that, when attached together in stacked arrangement, generally form a cylindrical body. From top to bottom, these sections include a handle section 802, a filter section 804, and an impeller section 806. The bottom of the handle section 802 may attach to the top of the filter section 804, and the bottom of the filter section 804 may attach to the impeller section 806. The bottom of the impeller section 806 may selectively couple to the impeller 120 as discussed above. As illustrated in FIGS. 7-13, these sections 802, 804, 806 are connected together in the attached state.

Figure 14:
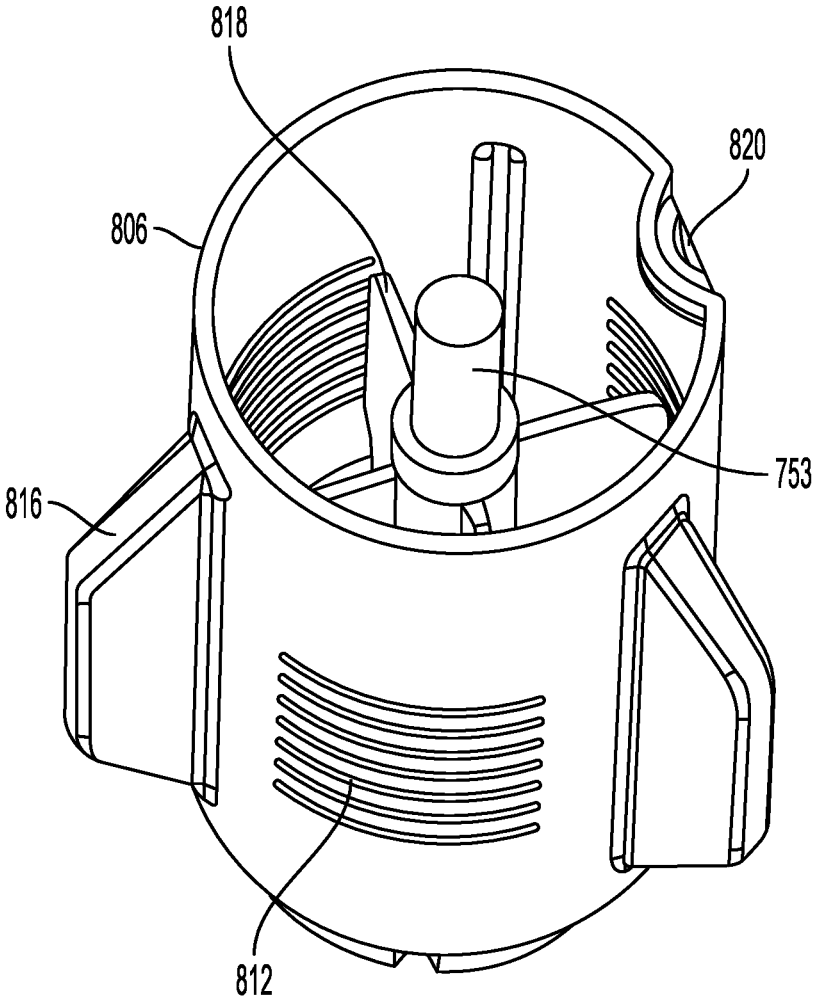
FIG. 14 is a perspective view of the impeller section of the removable agitator of FIG. 7.
Figure 15:
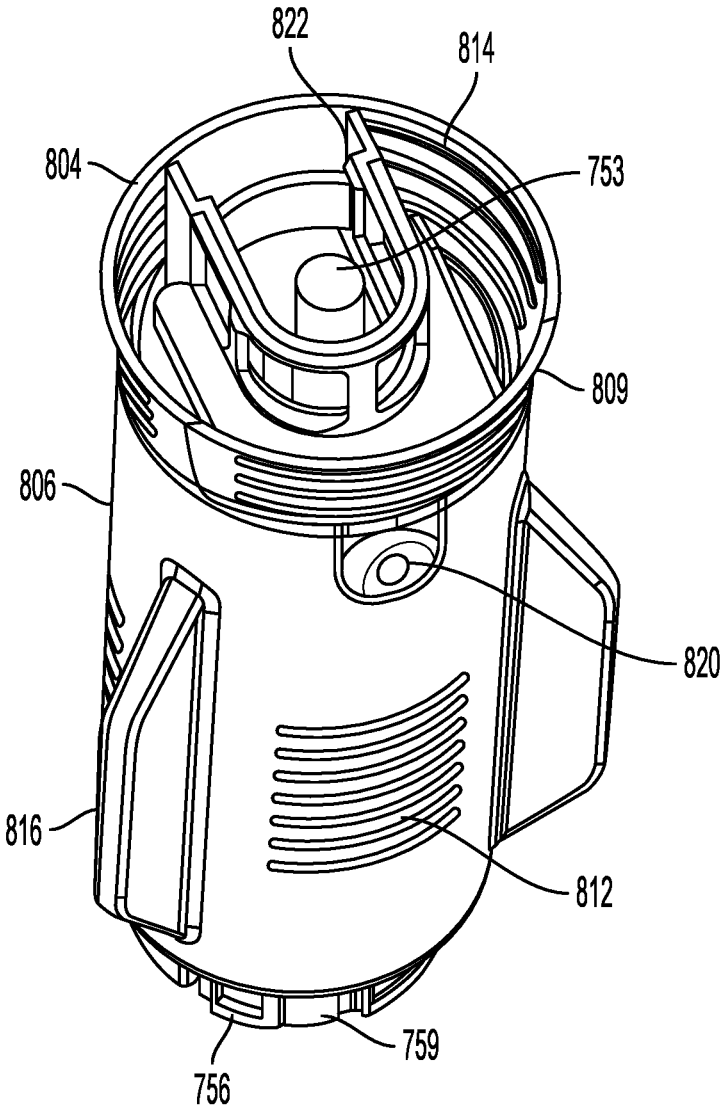
FIG. 15 is a perspective view of the filter section and impeller section of the removable agitator of FIG. 7.

FIG. 14 illustrates a perspective view of the impeller section 806 of the removable agitator of FIG. 7. In this view, the impeller section 806 is detached from the filter section 804. FIG. 15 is a perspective view of the filter section 804 and impeller section 806 of the removable agitator of FIG. 7. In this view, the filter section 804 and impeller section 806 are attached to one another, but the handle portion 802 is detached.

Referring collectively to FIGS. 7-15, the handle section 802 may be of a generally cylindrical shape, with the handle portion 751 at its upper end. The handle portion 751 may in some examples, taper inward, generally reducing in diameter from the lower base of the handle portion 751 to the top end of the handle portion 751. As noted above, the handle portion 751 may facilitate the insertion and removal of the agitator 850 by giving the user a convenient handle to grip onto and to rotate the agitator 850 as needed. The agitator 850 further includes a handle pull locking post 753 provided within the interior of the agitator 850, such that the locking post 753 is nested within the agitator 850. The locking post 753 can include a handle pull portion 757 positioned such that the user can grip the handle portion 751 of the agitator 850 and the handle pull portion 757 of the locking post 753 at the same time. The at least one first pin 759, illustrated herein as a plurality of first pins 759, protrude downwardly from the locking post 753, and thus also from the agitator 850, adjacent the at least one second pin 756. In one example, the first pins 759 and the second pins 756 can be provided in an alternating manner, such that the first pins 759 are received between the second pins 756.

The handle section 802 further includes an upper water opening 808 extending into a passage in the interior of the agitator 850. This upper water opening 808 may extend circumferentially around the side of the handle section 802. The upper water opening 808 may generally allow for the passage of water into or out of the interior of the agitator 850. A screen or other mesh may cover the upper water opening 808 to prevent the passage or catching of fabric items into the upper water opening 808.

The impeller section 806 may also be of a generally cylindrical shape and may define a hollow interior. As illustrated, impeller section 806 has a closed bottom, generally cylindrical sides, and an open top. The impeller section 806 may further define a lower water opening 812 to allow for the passage of water into or out of the interior space of the agitator 850. In an example, the lower water opening 812 may be formed as an array of evenly spaced slots extending circumferentially around a portion of the exterior of the impeller section 806. These slots may be sized large enough provide water flow, but small enough to prevent the passage or catching of fabric items into the lower water opening 812.

The impeller section 806 may further include a configuration of vanes 816 for imparting mechanical energy to laundry items during a cycle of operation. Generally, the vertical extent of the agitator 850, combined with the vanes 816, can impart the mechanical action to laundry items, which provides improved cleaning performance and can be suitable for particularly soiled loads. As shown, the example impeller section 806 includes three equally spaces vertical vanes 816 that extend radially outward from the cylindrical body of the impeller section 806. However, it should be noted that other quantities or arrangements of vanes 816 may additionally or alternately be used.

The impeller section 806 also includes an impeller 818. As best seen in FIG. 14, the impeller 818 may be vertically centered within the cylindrical interior chamber of the impeller section 806 and may fit and spin freely around the handle pull locking post 753. The impeller 818 may define a series of vanes that extend radially outward from the center of the impeller 818, so as to provide for agitation of the water within the impeller section 806. In some examples, the impeller 818 may be powered to actively spin via gearing in the impeller 120 that selectively connects when the impeller section 806 is connected to the impeller 120.

The filter section 804 may also be of a generally cylindrical shape. The exterior of the filter section 804 defines a midsection water opening 812 to allow for the passage of water into or out of the interior of the agitator 850. In an example, the midsection water opening 812 may be formed as an array of evenly spaced slots extending circumferentially around a portion of the exterior of the filter section 804. These slots may be sized large enough provide water flow, but small enough to prevent the passage or catching of fabric items into the lower water opening 812.

The filter section 804 may also include a vertical partition 822 to separate the interior space of the filter section into two portions. As best seen in FIG. 13, a first, inner space defined within the vertical partition 822 may be open to the hollow interior of the impeller section 806. Additionally, a second, outer space may be defined between the exterior of the vertical partition 822 and the interior wall of the filter section 804. The midsection water opening 812 may be open to the second space but closed to the first space, as best seen in FIG. 15.

The filter section 804 may also house a removable filter drawer 809. The removable filter drawer 809 may have a bottom, a front face, a rear face, and open exterior sides. The filter section 804 may have a corresponding opening about its exterior circumference into which the removable filter drawer 809 may be horizontally inserted. The rear face of the removable filter drawer 809 may be formed to fit the contour of the vertical partition 822. The vertical partition 822 may also define a stop such that the removable filter drawer 809 may only be inserted to a predefined extent. The front face of the removable filter drawer 809 may be formed such that when the removable filter drawer 809 is fully inserted against the vertical partition 822, the cylindrical front face of the filter section 804 may be flush with the exterior of the filter section 804 to generally continue the cylindrical exterior around the filter section 804.

The rear face of the filter drawer 809 may include a mesh or other filter material, and the vertical partition 822 of the filter section 804 may be open to the rear face of the filter drawer 809. This may allow for the filtered flow of water between the inner space within the vertical partition 822 and the outer space of the filter section 804. The filter section 804 may further define a latch 820 configured to hold the removable filter drawer 809 in place within the filter section 804 during a wash cycle. During the wash cycle, as water travels through the filter material of the rear face, lint, pet hair, or other particulate in the water wash may be captured by the filter material. After the wash cycle, the latch 820 may be undone and the filter drawer 809 may be removed from the filter section 804 and cleaned and/or replaced.

Figure 16:
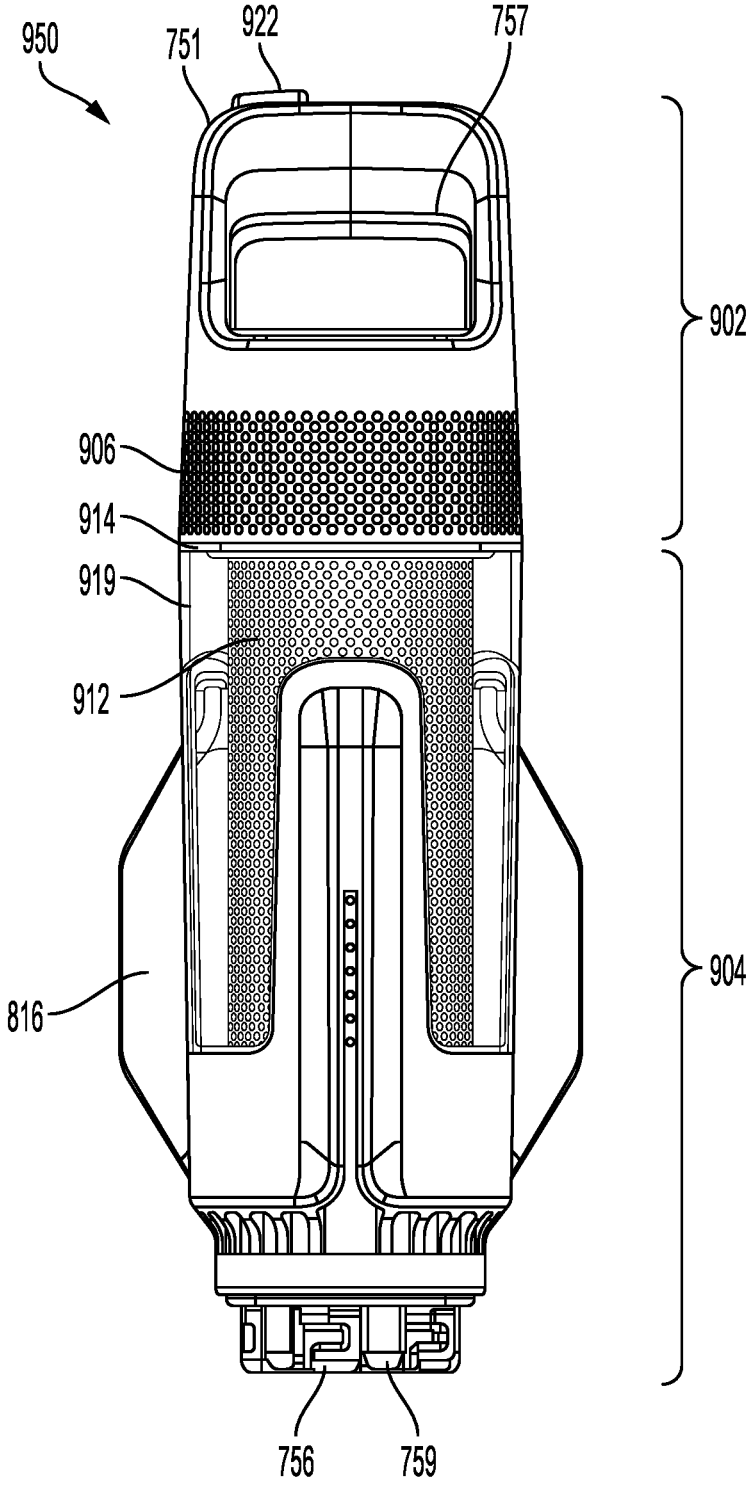
FIG. 16 is a side view of an alternate removable agitator in a first radial position about its longitudinal axis.
Figure 17:
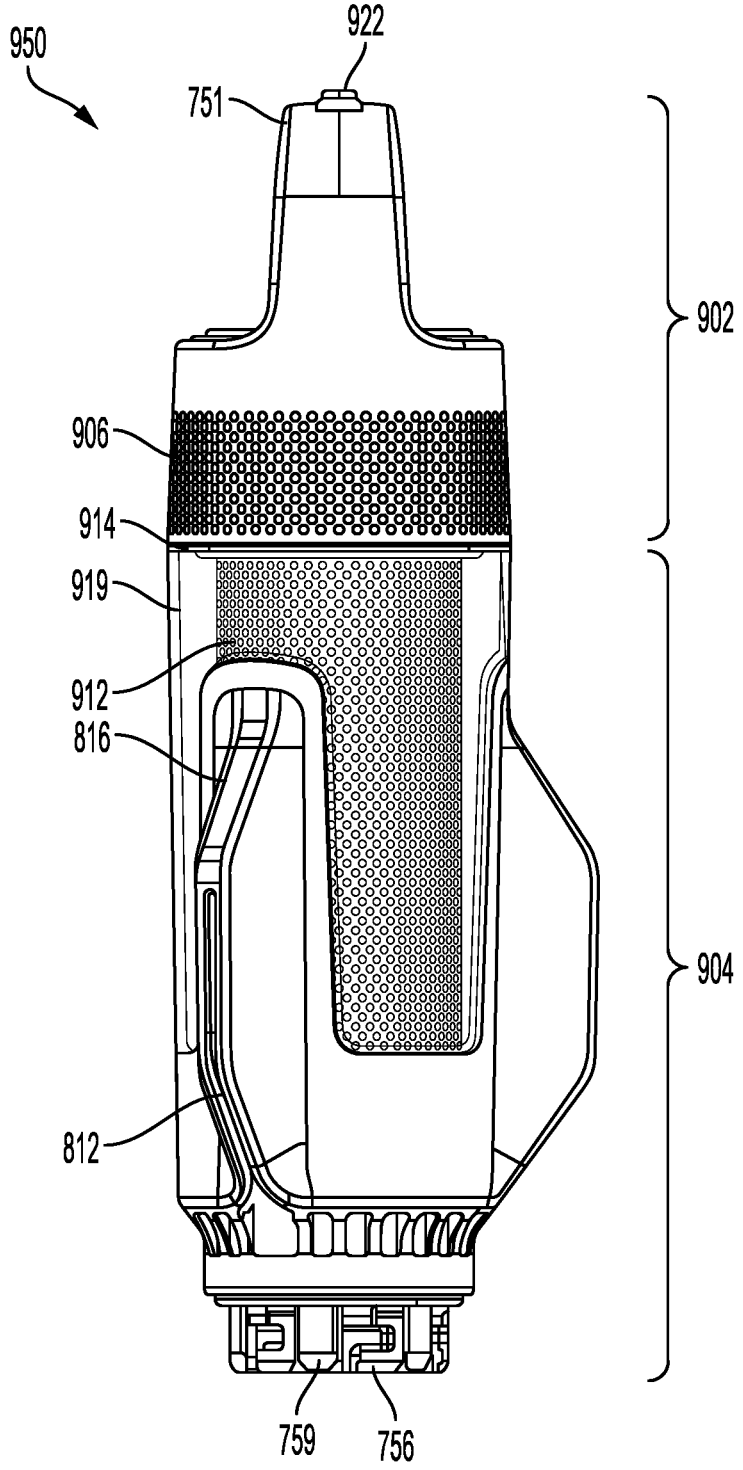
FIG. 17 is a side view of the removable agitator of FIG. 16 in a second radial position about its longitudinal axis.
Figure 18:
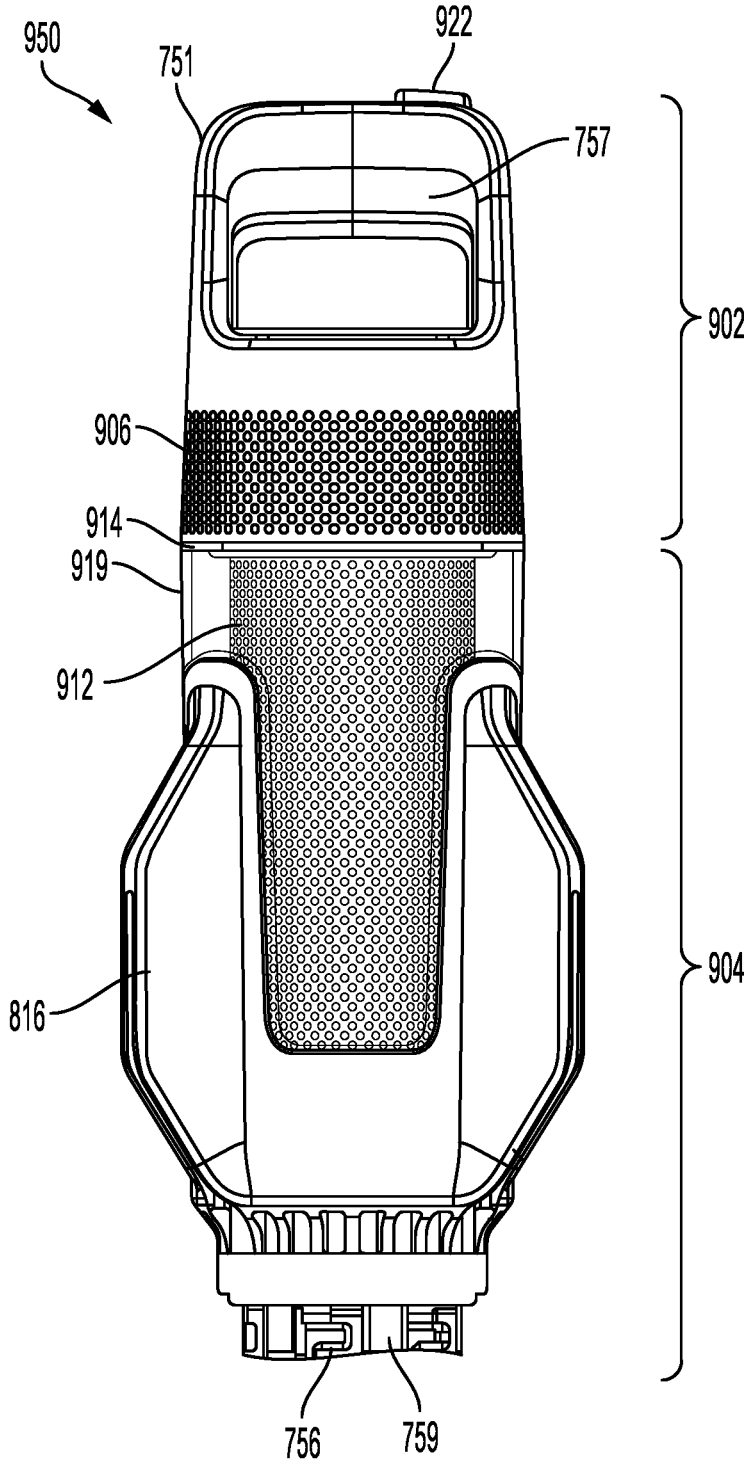
FIG. 18 is a side view of the removable agitator of FIG. 16 in a third radial position about its longitudinal axis.
Figure 19:
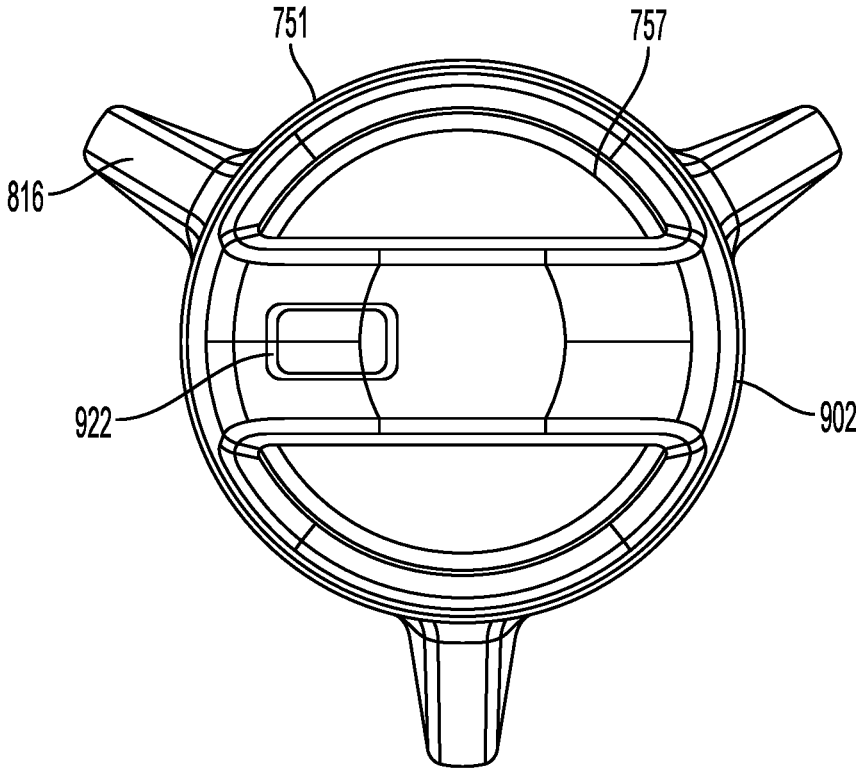
FIG. 19 is a top view of the removable agitator of FIG. 16.
Figure 21:
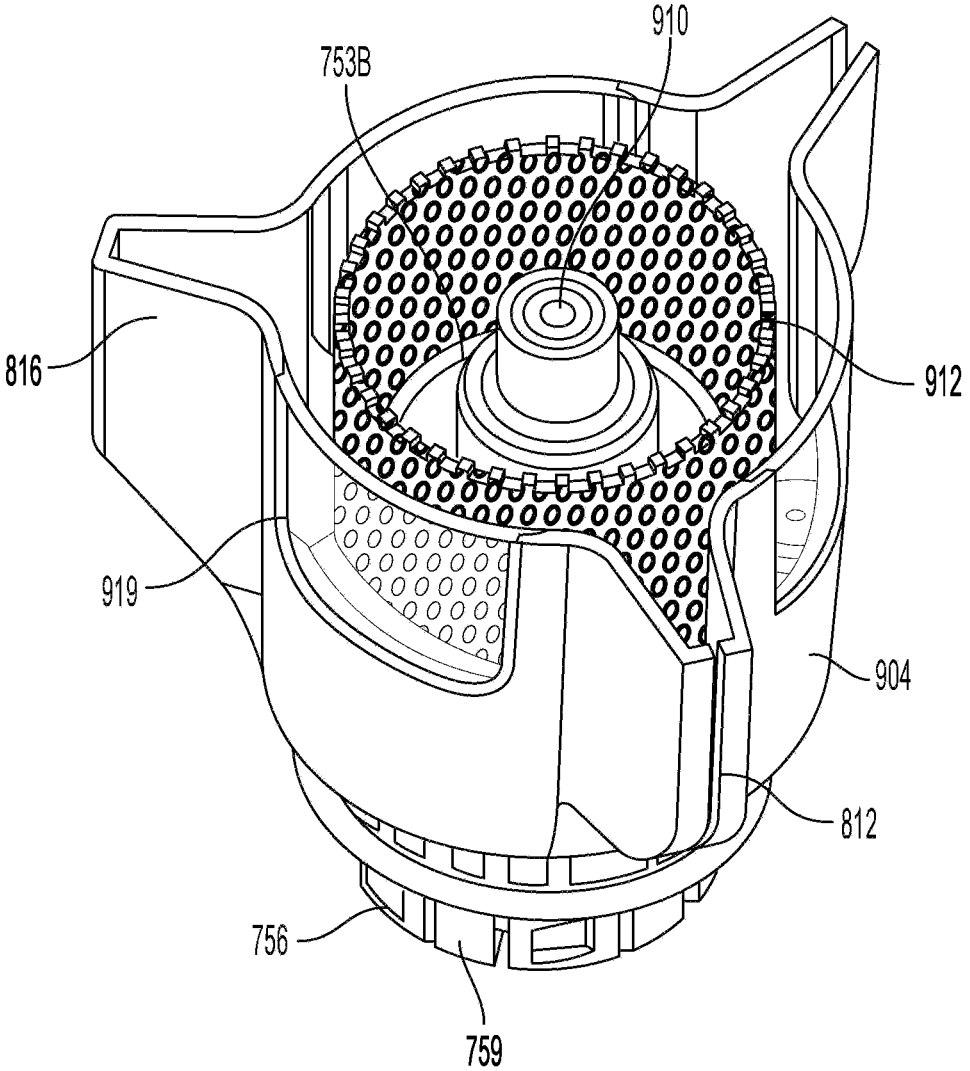
FIG. 21 is a perspective view of the top of the lower section of the removable agitator of FIG. 16.
Figure 22:
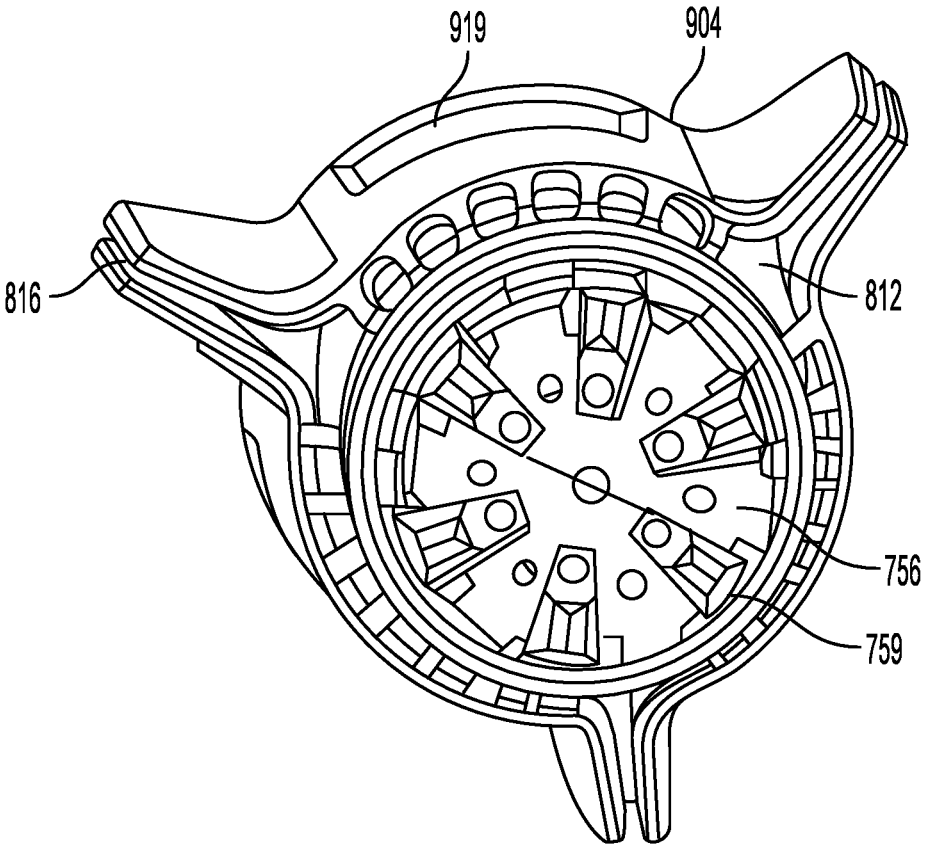
FIG. 22 is a perspective view of the bottom of the lower section of the removable agitator of FIG. 16.
Figure 23:
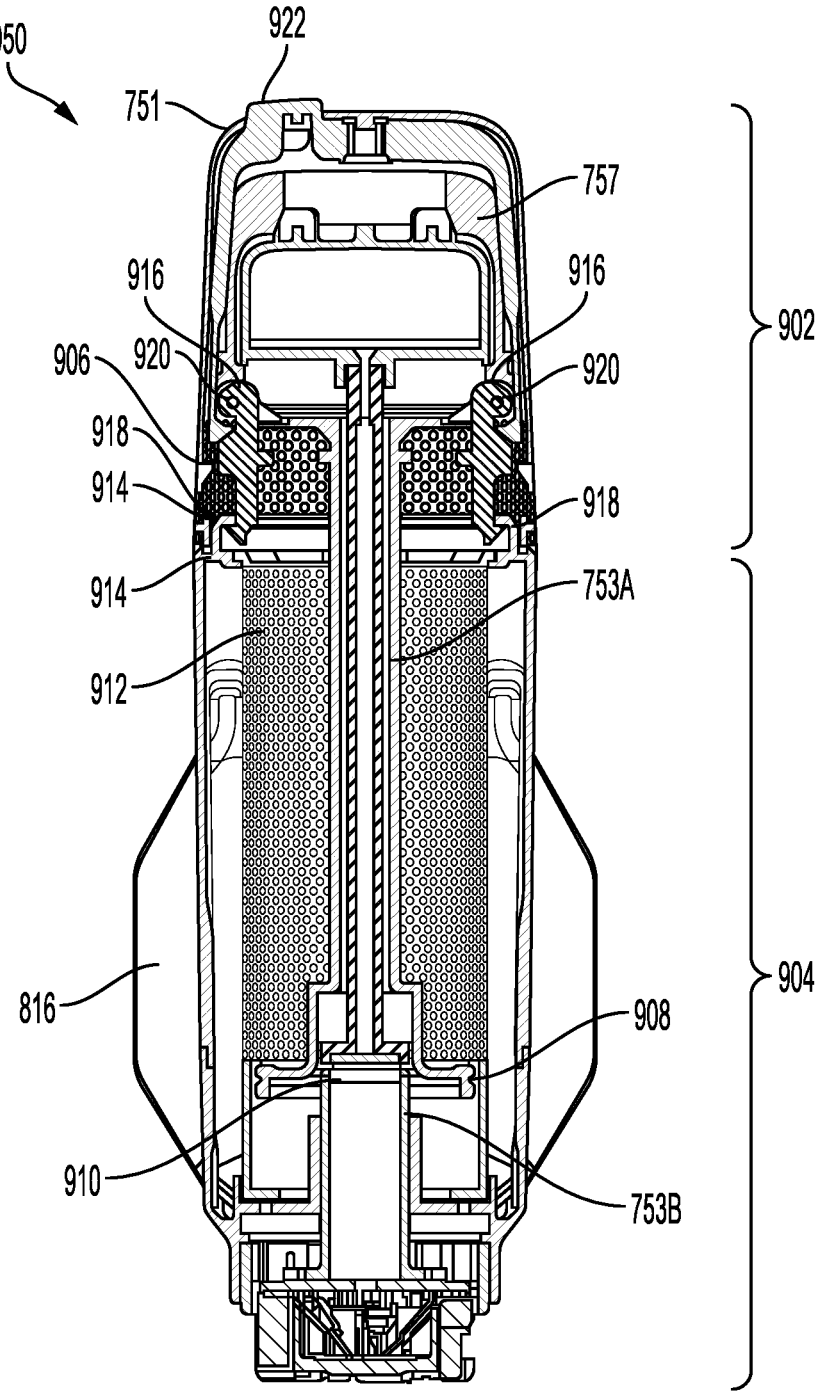
FIG. 23 is a side cross-sectional view of the removable agitator of FIG. 16 in the first radial position.
Figure 24:
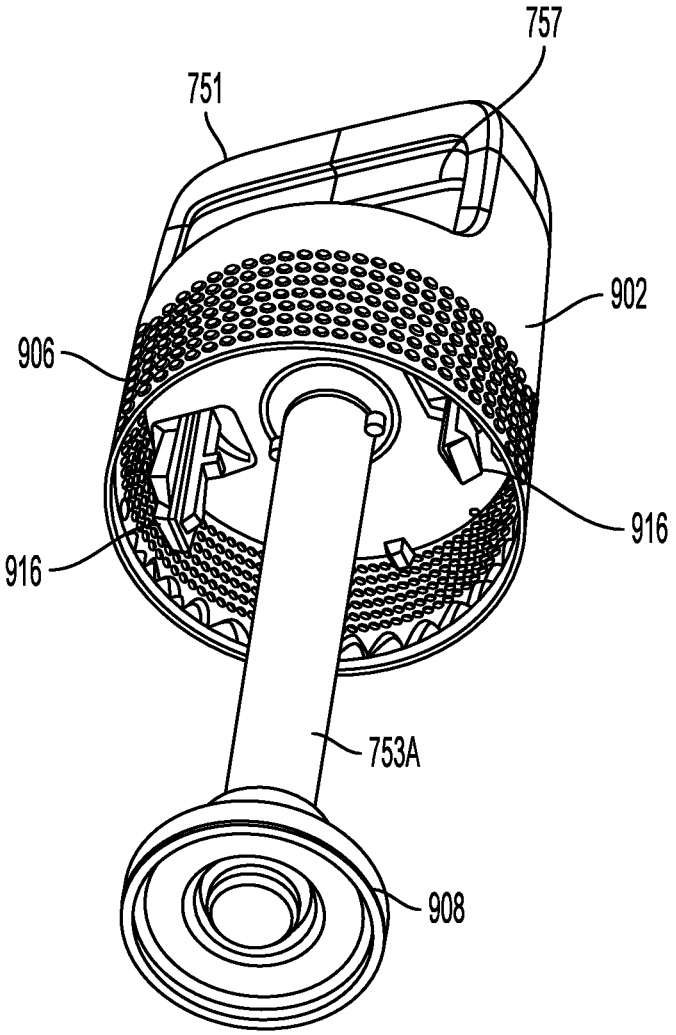
FIG. 24 is a perspective view of the upper section of the removable agitator of FIG. 16.

FIGS. 16-24 describe an alternate embodiment of the removable agitator 950 having filtration capabilities with a different configuration. FIG. 16 is a side view of an alternate removable agitator 950 in a first radial position about its longitudinal axis. FIG. 17 is a side view of the removable agitator 950 of FIG. 16 in a second radial position about its longitudinal axis. FIG. 18 is a side view of the removable agitator 950 of FIG. 16 in a third radial position about its longitudinal axis. FIG. 19 is a top view of the removable agitator 950 of FIG. 16. FIG. 20 is a bottom view of the removable agitator 950 of FIG. 16. FIG. 21 is a perspective view of the top of the lower section 904 of the removable agitator 950 of FIG. 16. FIG. 22 is a perspective view of the bottom of the lower section 904 of the removable agitator 950 of FIG. 16. FIG. 23 is a side cross-sectional view of the removable agitator 950 of FIG. 16 in the first rotation. FIG. 24 is a perspective view of the upper section 902 of the removable agitator 950 of FIG. 16.

Similar to the agitator 850, the agitator 950 may comprise a plurality of selectively attachable and detachable sections that, when attached together top to bottom in a stacked arrangement, generally form a cylindrical body. From top to bottom, these sections may include a handle section 902 and a filter section 904. The bottom of the handle section 902 may be attached to the top of the filter section 904, and the bottom of the filter section 904 may selectively couple to the impeller 120 as discussed above. As shown in FIGS. 16-20 and 23, these sections 902 and 904 are connected together in the attached state. As shown in FIGS. 21 and 22, the filter section 904 is alone and detached from the handle section 902. As shown in FIGS. 23, the handle section 902 is alone and detached from the filter section 804.

Referring collectively to FIGS. 16-24, the upper section 902 may be of a generally cylindrical shape, with the handle portion 751 being at an upper end of the agitator 950. As noted above, the handle portion 751 may facilitate the insertion and removal of the agitator 950 by giving the user a convenient handle to grip onto and to rotate the agitator 950 as needed.

However, in the agitator 950, the locking post 753 is a two-piece post as opposed to the solid post design of the agitator 850. An upper locking post 753A includes the handle pull portion 757 positioned such that the user can grip the handle portion 751 of the agitator 950 and the handle pull portion 757 of the upper locking post 753A at the same time. The upper locking post 753A extends centrally downwards through the interior of the agitator 950 to mate with a connector of the lower locking post 753B. For instance, the lower end of the upper locking post 753A may include a gripping connector 908 (best shown in FIG. 24) configured attach to the top end connector 910 (best shown in FIG. 21) of the lower locking post 753B. Attachment of the gripping connector 908 to the top end connector 910 may be done in various ways, such as magnetically or using a snap mechanism, as two possibilities. Similar to the agitator 950, the plurality of pins 759 protrude downwardly from the lower locking post 753B, and thus also from the agitator 950, adjacent to the at least one pin 756. Thus, when the upper locking post 753A and the lower locking post 753B are connected, the user can grip the handle portion 751 of the agitator 850 and the handle pull portion 757 of the locking post 753 at the same time to lift the plurality of pins 759.

The handle section 902 further includes an upper water opening 906 into a passage in the interior of the agitator 950. This upper water opening 906 may extend circumferentially around the lower end of the side of the handle section 902. The upper water opening 906 may generally allow for the passage of water into or out of the interior of the agitator 950. A screen or other mesh may cover the upper water opening 906 to prevent the passage or catching of fabric items into the upper water opening 906.

The filter section 904 may be of a generally cylindrical shape and may define a hollow interior providing for the internal flow of wash water, the filter section 904 having a closed bottom (with the exception of the lower water opening 812), generally cylindrical sides, and an open top.

The filter section 904 may further include a configuration of vanes 816 for imparting mechanical energy to laundry items during a cycle of operation. As shown, the example filter section 904 includes three equally spaces vertical vanes 816 that extend radially outward from the cylindrical body of the filter section 904. However, it should be noted that other quantities or arrangements of vanes 816 may additionally or alternately be used. As best seen in FIG. 21, and in contrast to the closed vanes 816 of the agitator 805, the vanes 816 of the agitator 950 are hollow and open to the interior of the filter section 904.

The filter section 904 may further define the lower water opening 812 to allow for the passage of water into or out of the interior space of the agitator 950. In an example, the lower water opening 812 may be formed as an array of openings extending circumferentially around the lower portion of the exterior of the filter section 904. These slots may be sized large enough provide water flow, but small enough to prevent the passage or catching of fabric items into the lower water opening 812. In some examples, the lower water opening 812 may extend upward along the vanes 816, providing for additional wash water flow between the interior of the impeller section 806 and the basket 30.

The filter section 904 may be configured to hold filter media 912. As shown, the filter media 912 may be constructed as an open-ended hollow cylinder of a narrower diameter compared to that of the interior of the agitator 950. When the filter section 904 is in a detached state, the filter media 912 may be vertically placed into the filter section 904, with a lower end placed in a position surrounding the lower locking post 753B. As best seen in FIG. 23, the upper end of the filter media 912 may fit inside a lip 914 extending inward from the exterior of the body of the filter section 904. The lip 914 may serve both to secure the upper end of the filter media 912, as well as to direct the flow of water from above into the interior of the filter media 912.

The handle section 902 may be attached to the top of the filter section 904. Once installed, a water flow path may be defined from the upper water opening 906 into the interior of the filter media 912. The lip 914 may block the flow of water from the upper water opening 906 to the exterior of the filter media 912. The water flow may continue through the filter media 912 and out the lower water opening 812. It should also be noted that the water flow direction may be reversed, and water may flow into the lower water opening 812, through the filter media 912 and up and out of the upper water opening 906. Regardless of direction, during the wash cycle, as water travels through the filter media 912, lint, pet hair, or other particulate in the water wash may be captured by the filter media 912.

The filter section 904 may also include a clear window 919, made of a material such as a clear plastic. The window 919 may allow for a user to be able to see inside the filter section 904. This may allow the user to visually inspect the filter media 912, to see if the filter media 912 is in need of replacement.

The agitator 950 may include a locking mechanism to secure the handle section 902 and the filter section 904 together. For instance, as best shown in FIG. 23, the handle section 902 may include one or more hook locks 916 that, in a locked state catch against a flange 918 of the filter section 904. The hook locks 916 may be each biased outward generally with respect to a corresponding pivot 920 to secure the filter section 904 to the handle section 902 in the attached state. The agitator 950 may further include a release mechanism 922 that, when pressed downward, pushes inward against the hook locks 916 to overcome the bias and cause the hook locks 916 to rotate inwards, releasing the handle section 902 from the filter section 904. This may allow the user to open the agitator 950 to clean or replace the filter media 912.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A removable agitator, comprising:

an impeller section defining a bottom portion of a hollow interior of the agitator;

a filter section, removably attachable to the top of the impeller section and defining a middle portion of the hollow interior, the filter section configured to hold a removable filter to filter water flowing within the agitator;

a handle section removably attachable to the top of the filter section and defining an upper portion of the hollow interior, the handle section further defining an area to grip onto and rotate the agitator facilitate insertion and removal of the agitator into a laundry treatment machine; and a lock provided within the hollow interior of the agitator, the lock including a handle portion controllable at a top end of the agitator to control a locking portion at a bottom end of the agitator for selectively locking the agitator into the laundry treatment machine.

2. The agitator of claim 1, wherein the impeller section defines a configuration of vanes about the circumference of the agitator for imparting mechanical energy to laundry items during a cycle of operation.

3. The agitator of claim 1, wherein the agitator defines a first water opening and a second water opening such that one or more of:

the first water opening of the agitator is formed as an array of evenly spaced slots extending circumferentially around a portion of the exterior of the impeller section; and the second water opening of the agitator is formed as an array of evenly spaced slots extending circumferentially around a portion of the exterior of the filter section.

4. The agitator of claim 3, further comprising a removable filter drawer having a bottom, a front face, a rear face, and open exterior sides, wherein the filter section defines a corresponding opening about its exterior circumference into which the removable filter drawer is horizontally insertable.

5. The agitator of claim 4, wherein the filter section comprises a partition defining a first, inner space open to the hollow interior of the impeller section, a second, outer space open to the second water opening but closed to the first space, and a filter area open to the first and second spaces configured to hold the removable filter to filter the water flowing between the inner space and the outer space, the rear face of the removable filter drawer being formed to fit a vertical contour of the partition, the partition defining a stop such that the removable filter drawer is insertable to a predefined extent.

6. The agitator of claim 5, wherein the front face of the removable filter drawer is formed such that when the removable filter drawer is fully inserted against the partition, a cylindrical front face of the filter section is flush with the exterior of the filter section to generally continue a cylindrical exterior around the filter section.

7. The agitator of claim 5, wherein the rear face of the filter drawer includes a mesh or other filter material, and the partition of the filter section is open to the rear face of the filter drawer to allow for a filtered flow of the water between the inner space within the partition and an outer space of the filter section.

8. The agitator of claim 5, wherein the filter section defines a latch configured to hold the removable filter drawer in place within the filter section during a wash cycle.

9. A removable agitator, comprising:

a handle section forming an upper portion of a hollow interior and an upper portion of an exterior face of the agitator, the handle section defining a grip to facilitate insertion and removal of the agitator into a laundry treatment machine and an upper water opening into a passage in the interior of the agitator;

a filter section forming a lower portion of the hollow interior and the exterior face, the top of the filter section being removably attachable to the bottom of the handle section, the lower portion of the hollow interior defining a bottom, generally cylindrical sides, an open top, and a lower water opening to allow for the passage of water into or out of the hollow interior of the agitator, the filter section configured to hold filter media; and a lock provided within the hollow interior of the agitator, the lock including a handle portion controllable at a top end to control a locking portion at a bottom end to selectively lock the agitator into the laundry treatment machine, wherein, when the handle section is attached to the filter section, the handle section and the filter section collectively define a water flow path for wash water in or out of the upper water opening into the interior of the filter media, through the filter media, and in or out of the lower water opening.

10. The agitator of claim 9, wherein the filter section defines a configuration of vanes for imparting mechanical energy to laundry items during a cycle of operation.

11. The agitator of claim 9, wherein the lock comprises a two-piece locking post including an upper locking post and a lower locking post, the upper locking post including a handle pull portion at the top end and extending centrally downwards through the interior of the agitator to a gripping connector to mate with a top end connector of the lower locking post, the lower locking post including a plurality of pins that protrude downwardly from the lower locking post, wherein, when the upper locking post and the lower locking post are connected, upward movement of the handle pull portion with respect to the handle section lifts the plurality of pins.

12. The agitator of claim 11 wherein attachment of the gripping connector to the top end connector includes a magnetic mechanism or a snap mechanism.

13. A removable agitator, comprising:

a plurality of selectively attachable and detachable stackable sections, the sections including a handle section and one or more further sections, wherein, when attached together in stacked arrangement one above another to form the agitator, the plurality of sections collectively define a cylindrical body having a hollow interior, wherein the cylindrical body defines first and second openings to provide a water flow path into and out of the hollow interior;

a partition defining a first space open to the hollow interior, a second space open to outside the agitator through the first opening but closed to the first space, and a filter area open to the first and second spaces to hold a removable filter to filter water flowing through the filter area; and a locking post vertically slidable within the hollow interior between a locked position and an unlocked position, the locking post including a handle portion controllable at a top end of the agitator to control a locking portion at a bottom end of the agitator for selectively locking the agitator into a laundry treatment machine.

14. The agitator of claim 13, wherein the locking portion of the locking post includes at least one pin at the bottom end to selectively lock the agitator into the laundry treatment machine in the locked position and to unlock the agitator from the laundry treatment machine in the unlocked position.

15. The agitator of claim 14, further comprising an impeller vertically centered within the hollow interior to fit and spin freely around the locking post, wherein the impeller defines a series of vanes extending radially outward from the center of the impeller so as to provide for agitation of the water within the hollow interior.

16. The agitator of claim 15, wherein the impeller is powered to actively spin via gearing that selectively connects when the agitator is connected to a base.

17. The agitator of claim 13, wherein one or both of the first and second openings is formed as an array of evenly spaced slots extending horizontally or longitudinally around at least a portion of the exterior of the agitator.

18. The agitator of claim 13, wherein at least a portion of the plurality of sections collectively define a configuration of vanes about a circumference of the agitator for imparting mechanical energy to laundry items during a cycle of operation.

19. The agitator of claim 13, wherein the one or more further sections include a filter section and an impeller section, wherein:

the bottom of the handle section is configured to attach to the top of the filter section, the bottom of the filter section is configured to attached to the top of the impeller section, and the bottom of the impeller section is configured to selectively couple to the laundry treatment machine.

20. The agitator of claim 13, wherein the one or more further sections includes an impeller section, wherein:

the bottom of the handle section is configured to attach to the top of the impeller section, and the bottom of the impeller section is configured to selectively couple to the laundry treatment machine.

* * * * *